US009879389B1

(12) United States Patent
Lura

(10) Patent No.: US 9,879,389 B1
(45) Date of Patent: Jan. 30, 2018

(54) POWERED ROLLER SCREED WITH ADJUSTABLE HANDLE FOR WET SCREED ATTACHMENT

(71) Applicant: Lura Enterprises, Inc., West Fargo, ND (US)

(72) Inventor: Dennis K. Lura, Fargo, ND (US)

(73) Assignee: LURA ENTERPRISES, INC., West Fargo, ND (US)

( * ) Notice: Subject to any disclaimer, the term of this patent is extended or adjusted under 35 U.S.C. 154(b) by 0 days.

(21) Appl. No.: 14/879,784

(22) Filed: Oct. 9, 2015

Related U.S. Application Data

(60) Provisional application No. 62/072,845, filed on Oct. 30, 2014.

(51) Int. Cl.
*E01D 19/00* (2006.01)
*E01C 19/35* (2006.01)
*E04G 21/10* (2006.01)

(52) U.S. Cl.
CPC ..... *E01C 19/35* (2013.01); *E04G 21/10* (2013.01)

(58) Field of Classification Search
CPC ..... E01C 19/23; E01C 19/35; E04G 21/10
USPC ..... 404/101, 103, 106; 125/13.01–16.01
See application file for complete search history.

(56) References Cited

U.S. PATENT DOCUMENTS 1,615,905 A 2/1927 Hunt
1,702,585 A 2/1929 Bell
2,048,071 A 7/1936 Jacobson
2,351,719 A 6/1944 Stahl
3,605,577 A * 9/1971 Bik ..... E01C 19/29 404/122
3,801,211 A * 4/1974 Perkins ..... E01C 11/24 404/103
4,142,815 A * 3/1979 Mitchell ..... E04G 21/10 404/103
4,702,640 A * 10/1987 Allen ..... E01C 19/24 404/103
4,778,304 A 10/1988 Baldi et al.
4,869,618 A 9/1989 Morrison
5,115,536 A * 5/1992 Jarvis ..... B25G 3/38 15/144.1
5,190,401 A 3/1993 Wilson
5,288,166 A 2/1994 Allen et al.
5,328,295 A 7/1994 Allen
5,456,549 A 10/1995 Paladeni
5,803,656 A 9/1998 Turck
6,350,083 B1 2/2002 Paladeni
6,402,425 B1 * 6/2002 Paladeni ..... E04F 21/24 404/103
6,474,906 B1 * 11/2002 Cunningham ..... E01C 19/29 404/103

(Continued)

FOREIGN PATENT DOCUMENTS

EP 0 693 591 B1 1/1996
EP 0 753 626 A1 1/1997
GB 909 194 A 10/1962

*Primary Examiner* — Raymond W Addie
(74) *Attorney, Agent, or Firm* — Marsh Fischmann & Breyfogle LLP

(57) ABSTRACT

A cement screeding system in the form of a powered roller screed with a wet screed attachment. The wet screed attachment includes a wet screed shoe. A handle is rotationally isolated from the screed roller and is rigidly coupled to this wet screed shoe. As such, motion of this handle is transmitted to the wet screed shoe in a replicating fashion.

28 Claims, 14 Drawing Sheets

(56) References Cited

U.S. PATENT DOCUMENTS

| | | | | |
|---|---|---|---|---|
| 6,503,558 | B2 | 1/2003 | Williamson | |
| D477,152 | S | 7/2003 | Levy | |
| 6,758,631 | B2 | 7/2004 | Frankeny, II | |
| 6,976,805 | B2 | 12/2005 | Quenzi et al. | |
| 7,121,762 | B2 | 10/2006 | Quenzi et al. | |
| 7,140,555 | B1 | 11/2006 | Bricko et al. | |
| 7,150,413 | B1 | 12/2006 | Bricko et al. | |
| 7,544,012 | B2 | 6/2009 | Lura | |
| 7,611,076 | B1 | 11/2009 | Street et al. | |
| 8,221,027 | B2 * | 7/2012 | Lura | E01C 19/24 404/101 |
| 8,419,313 | B2 * | 4/2013 | Lura | E01C 19/24 404/118 |
| 8,678,702 | B1 * | 3/2014 | De Jong | E01C 19/15 404/118 |
| 2003/0031751 | A1 | 2/2003 | Kikuchi | |

* cited by examiner

POWERED ROLLER SCREED WITH ADJUSTABLE HANDLE FOR WET SCREED ATTACHMENT

CROSS-REFERENCE TO RELATED APPLICATIONS

This patent application is a non-provisional application of, and claims priority to, U.S. Provisional Patent Application Ser. No. 62/072,845, that is entitled "POWERED ROLLER SCREED WITH ADJUSTABLE HANDLE FOR WET SCREED ATTACHMENT," that was filed on Oct. 30, 2014, and the entire disclosure of which is hereby incorporated by reference.

FIELD OF THE INVENTION

The present invention generally relates to the leveling of materials and, more particularly, to screeding wet concrete.

BACKGROUND

Concrete slabs are ubiquitous in today's world. From highways to airport runways to parking lots to building floors, sidewalks, and driveways, concrete slabs form the durable surfaces we depend on for modern life. The methods used to construct all these differing structures typically all require that the wet concrete mixture be poured, leveled, and compacted.

The concrete may be leveled and possibly compacted to at least a degree by screeding. The screeding process may be accomplished by the use of forms, most commonly 2 by 6 or 2 by 8 pieces of wood that are positioned in a parallel manner at the desired width. This form then operates to contain the poured concrete in a lateral area that is to be covered by the concrete slab. When the required amount of concrete is thus positioned, it is then necessary to level it off to the height of the forms. It is this later process in which the screed is employed. In this method, the leveling process may be accomplished by moving a flat piece of material spanning the two parallel forms in a back and forth manner. This operation serves to move any of the excess concrete that extends above the upper surfaces of the forms either into any low areas or off of the prospective slab altogether.

While the manual method described above works well enough on small jobs such as the repair of short sections of sidewalk, it has numerous deficiencies. The first of these is, that even in small jobs, it is labor intensive and therefore costly over the long term. Additionally, the use of a manual screed is not very effective at distributing and compacting the concrete within the form, therefore producing a finished slab of a lesser quality than is generally desired.

Powered screeds may be employed to assist in the screeding process. One type of powered screed is a powered roller screed. The powered roller screed generally consists of a screed roller (e.g., an elongated tube) that is rotationally driven by an attached motor. In operation, the screed roller is positioned over the raw or wet concrete with each end of the screed roller positioned on the upper edges of the forms. The screed roller is then moved along the top of the forms in a direction that is opposite the rotational motion of the screed roller at its point of contact with the concrete. This apparatus produces a smooth and flat finish to the concrete. This method is generally limited to producing concrete slabs in sections that are not wider than width of the screed roller, since each end of the screed roller must ride on a form.

Screeding may also be accomplished without the use of the aforementioned forms. Such a process is known as wet or free screeding. In wet screeding, generally a free-floating elongate blade is moved over the freshly poured concrete to compact and level the concrete. The wet screed apparatus may include a vibration producing mechanism to vibrate the blade, which may aid in compacting the concrete. Pads, posts or other indicators may be used to help the wet screed operator level the concrete at a particular height. Since no forms are needed, wet screeding is not limited to producing sections that are thinner than the length of the blade. Accordingly, wet screeding may be used to screed large concrete pads where the use of powered roller screeds may be impractical. However, wet screeding generally does not produce as high a quality surface as is generally achieved using a screed roller.

SUMMARY

The present invention generally pertains to a cement screeding system and is particularly suited for wet screeding applications. As used herein, the phrase "wet concrete" refers to concrete that has been poured or otherwise deposited onto a surface, and that has not yet hardened or become rigid such that the concrete may still be moved or manipulated to define a desired surface (e.g., wet concrete has at least a degree of viscosity such that is still able to "flow" or move in response to an applied pressure or force). Screeding may be described as moving a screed over wet concrete to level the wet concrete.

The cement screeding system of the present invention generally includes a screed roller, a drive assembly, first and second handles that are spaced from one another, and a wet screed shoe. The screed roller includes first and second oppositely disposed ends, and furthermore is rotationally interconnected with the drive assembly. The first and second handles, as well as the wet screed shoe, are each interconnected with the screed roller in a manner such that the screed roller is able to rotate relative to each of these components. The wet screed shoe is interconnected with the second end of the screed roller, includes a flat lower surface, and is rigidly coupled with the second handle.

A number of feature refinements and additional features are applicable to the present invention. These feature refinements and additional features may be used individually or in any combination.

The wet screed shoe associated with the present invention alleviates the need for the second end of the screed roller to be supported by a form or the like positioned adjacent to a typically recently poured and screeded section of wet concrete (a "first screeded section"). The screed roller is typically manipulated by an operator at the second handle during screeding operations such that the flat lower surface of the wet screed shoe is disposed flush with (i.e., in contact with and in at least substantially coplanar relation with the first screeded section), or is disposed at least substantially parallel to, and in closely spaced related to, the first screeded section. The wet screed shoe thereby may be used to dispose a pair of screeded concrete sections in at least substantially coplanar relation with one another. The wet screed shoe may also support the second end of the screed roller in at least certain instances (e.g., where the wet screed shoe is positioned on an adjacent and typically recently screeded section of wet concrete), such as when screeding operations have been suspended (e.g., while waiting for an additional concrete pour).

The drive assembly may be interconnected with the screed roller in any appropriate manner, including at the first end of the screed roller. Although the first handle could extend from the screed roller at a location that is spaced from the drive assembly (e.g., via a pull bearing assembly disposed between an adjacent pair of screed roller sections of the screed roller), the first handle may also be incorporated by the drive assembly (e.g., the first handle may extend from a frame of the drive assembly).

The drive assembly may include/utilize a power source, may be interconnected with the screed roller in any appropriate manner, and may be operable to rotatably drive the screed roller. Any appropriate power source may be utilized by the drive assembly. For instance, the drive assembly may utilize one or more motors of any appropriate type. Representative motors that may be used to rotate the screed roller include without limitation an electric motor, an internal combustion engine (e.g., a gas engine), and the like. In one embodiment, the screed roller is rotated at a relatively high velocity (e.g., at least about 100 RPM, including in a range from about 200 RMP to about 300 RPM, and including in a range from about 250 RPM to about 300 RPM) and in a direction that attempts to advance the screed roller in the opposite direction that the same is normally pulled during a screeding operation.

The screed roller may be of any appropriate size (e.g., length), shape (e.g., cylindrical), and/or configuration. The screed roller may be defined by detachably interconnecting two or more separate screed roller sections in end-to-end relation (e.g., via a threaded connection between each adjacent pair of screed roller sections; each screed roller section may have a threaded male member on one end and a threaded female member on its opposite end). Any appropriate number of detachably interconnected screed roller sections may be utilized to define a screed roller of a desired/required length. "Detachably interconnected" means that individual screed roller sections may be repeatedly joined and separated, or vice versa, as desired/required (e.g., joined for a screeding operation at a job site; separated or disassembled for transport and/or storage). Each separate screed roller section used by the screed roller may be of any appropriate length. Two or more of multiple screed roller sections that define the screed roller may be of different lengths, although such may not be the case in all instances. The overall length of the screed roller may be varied by removing and/or adding at least one screed roller section.

The wet screed shoe may include a bearing mount to rotatably support the second end of the screed roller. In the case where a cylindrical body of the screed roller provides the primary screeding surface of the cement screeding system, an end portion of this cylindrical body may extend over an upper surface of the bottom for the wet screed shoe for the screed roller to reach the bearing mount. This end portion of the cylindrical body may be disposed in closely spaced relation to the upper surface of the bottom for the wet screed shoe, but is preferably separated therefrom by a small space (e.g., no more than about ⅛"). An inwardly disposed sidewall of the wet screed shoe may include a cutout through which the screed roller extends in proceeding to the noted bearing mount.

The wet screed shoe may be configured to enhance one or more aspects of screeding operations (e.g., to provide a visual guide for wet screeding operations; to support the second end of the screed roller by positioning the wet screed shoe on a recently screeded section of wet concrete). The noted flat lower surface of the wet screed shoe may have a surface area of at least about 120 in.$^2$ in one embodiment, of at least about 165 in.$^2$ in another embodiment, and of at least about 220 in.$^2$ in yet another embodiment. A length dimension of the wet screed shoe may coincide with the primary direction in which the screed roller is pulled during screeding operations (e.g., at least substantially perpendicular to the rotational axis of the screed roller). The length of the flat lower surface of the wet screed shoe may be at least about 20 inches in one embodiment, at least about 23 inches in another embodiment, and at least about 26 inches in yet another embodiment. A width dimension of the wet screed shoe may be orthogonal to the noted length dimension (e.g., the width dimension of the wet screed shoe may coincide with the rotational axis of the screed roller). The width of the flat lower surface of the wet screed shoe may be at least about 6 inches in one embodiment, may be at least about 7.25 inches in one embodiment, and may be at least about 8.5 inches in yet another embodiment.

The wet screed shoe may include a pair of laterally spaced sidewalls and a pair of longitudinally spaced end walls that each extend upwardly from a bottom of the wet screed shoe. The sidewalls may extend upwardly from the bottom of the wet screed shoe by a distance of at least about ¾ inch in one embodiment along the entire length of the wet screed shoe (except where the "inside" sidewall may include a cutout for the screed roller), and by a distance of at least about 1 inch in another embodiment along the entire length of the wet screed shoe. The height of the two end portions of each of the sidewalls (adjacent to the two end walls) may be even higher, for instance at least 1.5 inches in one embodiment and at least about 2 inches in another embodiment. The upper edge of the two end walls of the wet screed shoe may be vertically spaced from the bottom by a distance of at least about 1.5 inches in one embodiment and by a distance of at least about 2 inches in another embodiment. This "perimeter wall" of the wet screed shoe should reduce the potential for wet concrete collecting on the upper surface of the bottom for the wet screed shoe during screeding operations. Moreover, each of the end walls may be ramped, inclined or otherwise shaped so as to reduce the potential of the wet screed shoe "digging in" during screeding operations, to facilitate "floating" of the wet screed shoe during screeding operations, or both.

A screed shoe bracket may be mounted to and maintained in a fixed position relative to the wet screed shoe. The second handle may be rigidly coupled with this screed shoe bracket, to in turn allow the second handle to be rigidly coupled with the wet screed shoe. The second handle may be rigidly coupled with the screed shoe bracket at a first location to define a first screed shoe/handle configuration for the cement screeding system (e.g., where the second handle is in a first orientation relative to the wet screed shoe, more specifically its flat lower surface). The second handle may also be rigidly coupled with the screed shoe bracket at a second location to define a different second screed shoe/handle configuration for the cement screeding system (e.g., where the second handle is in a second orientation relative to the wet screed shoe, more specifically its flat lower surface, and where the first and second orientations differ in at least some respect). The first screed shoe/handle configuration may utilize a first adjustment hole of the screed shoe bracket, while the second screed shoe/handle configuration may be provided by a different second adjustment hole of the screed shoe bracket.

The above-noted screed shoe bracket may include a plurality of adjustment holes. The screed shoe bracket may be disposed and/or the adjustment holes may be arranged such that each adjustment hole occupies a different position along a length or length dimension of the wet screed shoe (e.g., where the length dimension corresponds with the direction in which the wet screed shoe is advanced over a previously screeded section of concrete). The screed shoe bracket may be disposed and/or the adjustment holes may be arranged such that each adjustment hole is positioned the same distance from a rotational axis of the screed roller. The screed shoe bracket may be disposed and/or the adjustment holes may be arranged such that there is at least one set of adjustment holes, and where each adjustment hole in a given set of adjustment holes is disposed at a different elevation relative to the flat lower surface of the wet screed shoe.

Corresponding ends of the noted plurality of adjustment holes may be characterized as being disposed within a common reference plane that is perpendicular to a rotational axis of the screed roller. As such, the second handle may be moved/rotated at least generally about the rotational axis of the screed roller to select a different adjustment hole for rigidly coupling the second handle relative to the screed shoe bracket and thereby the wet screed shoe. An appropriate fastener may be used to detachably and rigidly couple the second handle with the screed shoe bracket, and thereby the wet screed shoe, using any of the adjustment holes of the screed shoe bracket. Such a fastener may be in the form of a bolt and nut, a locking pin alone or in combination with a locking wire or clip, and the like. Each adjustment hole of the screed shoe bracket may provide for a different relative orientation between the second handle and the wet screed shoe (e.g., its flat lower surface).

The screed shoe bracket may extend from a rearward location of the wet screed shoe (e.g., somewhere between a bearing mount and a rear end wall of the screed shoe, where this bearing mount rotatably supports the second end of the screed roller) to a forward location of the wet screed shoe (e.g., somewhere between this bearing mount and a forward end wall of the screed shoe). A first end of the screed shoe bracket may be anchored to the wet screed shoe on one side of the rotational axis of the screed roller (e.g., the noted rearward location), and an oppositely disposed second end of the screed shoe bracket may be anchored to the wet screed shoe on an opposite side of the rotational axis of the screed roller (e.g., the noted forward location). The screed shoe bracket may be characterized as extending along an arc or arcuate path proceeding from this rearward location of the wet screed shoe to the forward location of the wet screed shoe. The screed shoe bracket may be characterized as extending along a semi-circular path proceeding from this rearward location of the wet screed shoe to the forward location of the wet screed shoe, including where a rotational axis of the screed roller coincides with a center of this semi-circular path. One embodiment has an apex of the screed shoe bracket being disposed directly above the rotational axis of the screed roller. One embodiment has this apex of the screed shoe bracket being positioned along a reference line that extends through the rotational axis of the screed roller and that is also perpendicular to the flat lower surface of the wet screed shoe.

The second handle may be directly rigidly coupled to the screed shoe bracket. The second handle may also be rigidly coupled to the screed shoe bracket by an intermediate handle bracket, including where the second handle is rotationally isolated from the screed roller at a first location (e.g., via a first pull bearing disposed between adjacent screed roller sections of the screed roller that are detachably connected together). The handle bracket may extend from the second handle and may be detachably and rigidly coupled with the screed shoe bracket (e.g., via an adjustment hole and corresponding fastener). A first bracket section of the handle bracket may be appropriately secured relative to the second handle (e.g., detachably using one or more fasteners). A third bracket section of the handle bracket may extend from the screed roller at a second location where this third bracket section of the handle bracket is rotationally isolated from the screed roller (e.g., via a second pull bearing associated with the screed roller, and where the noted first pull bearing (second handle) is located between the second pull bearing (handle bracket) and the first end of the screed roller). A second bracket section of the handle bracket may extend between and interconnect the first and third bracket sections of the handle bracket. The third bracket section and the second handle may extend from the screed roller in at least substantially parallel relation such that they are able to exert commonly directed and spaced forces on the screed roller to change the orientation of the flat lower surface of the wet screed shoe.

One configuration has the second handle including a pair of gripping sections that are spaced along the length dimension of the screed roller, including where the second handle may be directly coupled to the screed shoe bracket to provide the rigid coupling between these components. In this instance one gripping section may be disposed at least substantially at the second end of the screed roller (via one handle extension that extends from a pull bearing assembly incorporated by the screed roller) and the other gripping section may be spaced inwardly from the second end of the screed roller (via another handle extension that extends from another pull bearing assembly that is incorporated by the screed roller). "Inward" from the second end of the screed roller means in the direction of the first end of the screed roller.

Another configuration has the second handle including a single gripping section. Exerting a force on this single gripping section may result in commonly directed forces (i.e., at least substantially parallel forces) being exerted on the screed roller at first and second locations that are spaced from one another along the length dimension of the screed roller (e.g., where the second handle extends from the screed roller (e.g., via one pull bearing assembly of the screed roller), and where the noted handle bracket extends from the screed roller (e.g., via another pull bearing assembly of the screed roller that is spaced in the direction of the first end of the screed roller)).

A screed roller section of the screed roller may be positioned between where the second handle extends from the screed roller (e.g., via an intermediate pull bearing) and the wet screed shoe. This may then space the entirety of the second handle inwardly from the second end of the screed roller. The entirety of each gripping section of the second handle (including where there is only a single gripping section for the second handle) may then be spaced inwardly from second end of the screed roller. This is beneficial in that this positions an operator inwardly from the second end of the screed roller when screeding a section of wet concrete and so as to be sufficiently spaced from an adjacent and typically recently screeded section of wet concrete. In one embodiment, an entirety of a gripping section of the second handle that is spaced inwardly from the second end of the screed roller is the closest gripping section of any handle utilized by the cement screeding system to this second end of the screed roller. In an embodiment where an entirety of a gripping section of the second handle is spaced inwardly from the second end of the screed roller, the cement screeding system may be configured such that there is no other gripping section for a handle that is positioned between this gripping section of the second handle and the second end of the screed roller.

Any feature of any other various aspects of the present invention that is intended to be limited to a "singular" context or the like will be clearly set forth herein by terms such as "only," "single," "limited to," or the like. Merely introducing a feature in accordance with commonly accepted antecedent basis practice does not limit the corresponding feature to the singular (e.g., indicating that a screed shoe bracket for a wet screed shoe of a powered roller screed includes "an adjustment hole" alone does not mean that the screed shoe bracket includes only a single adjustment hole). Moreover, any failure to use phrases such as "at least one" also does not limit the corresponding feature to the singular (e.g., indicating that a screed shoe bracket for a wet screed shoe of a powered roller screed includes "an adjustment hole" alone does not mean that the screed shoe bracket includes only a single adjustment hole). Use of the phrase "at least generally" or the like in relation to a particular feature encompasses the corresponding characteristic and insubstantial variations thereof (e.g., indicating that a screed roller is at least generally cylindrical encompasses the screed roller actually being cylindrical). Finally, a reference of a feature in conjunction with the phrase "in one embodiment" does not limit the use of the feature to a single embodiment.

DETAILED DESCRIPTION

Figure 1:
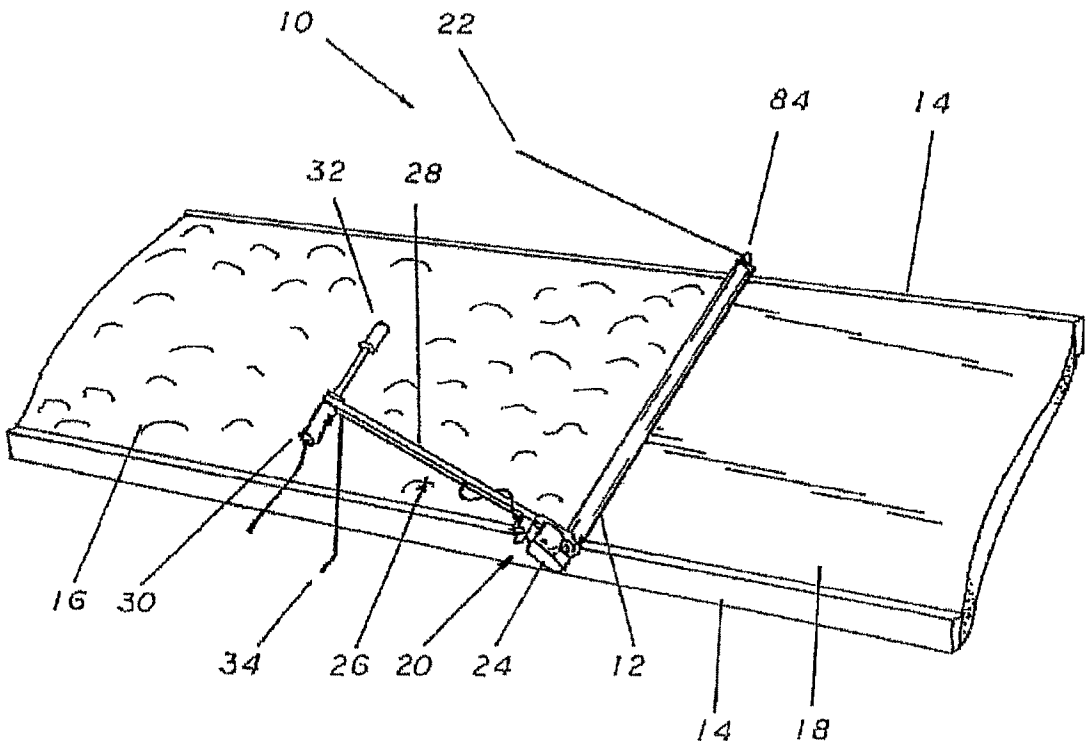
FIG. 1 is a perspective view of an embodiment of a powered roller screed that illustrates the manner in which it may be deployed to screed wet concrete.
Figure 2:
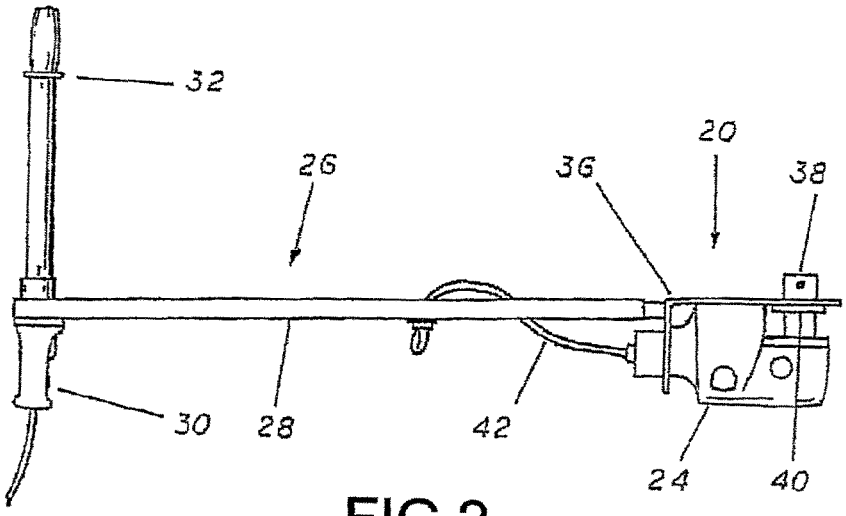
FIG. 2 is a top elevation view of a rotational drive assembly for the powered roller screed of FIG. 1.
Figure 3:
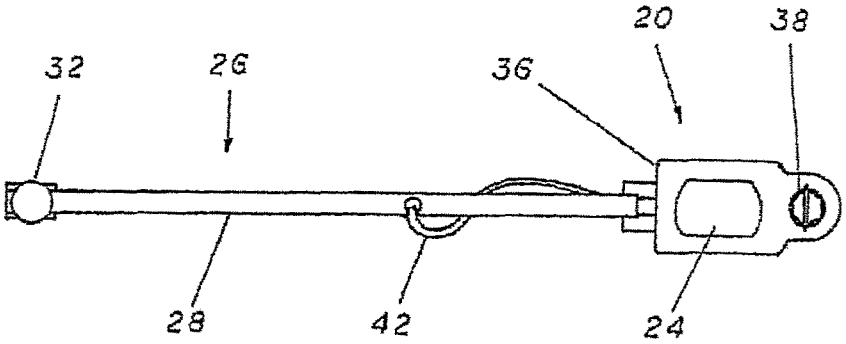
FIG. 3 is an end elevation view of the rotational drive assembly of FIG. 2.

Referring to the drawings, and more specifically initially to FIGS. 1-3, a powered rotational screed apparatus or powered roller screed 10 has a screed roller 12 that is adaptable to accommodate any number of specialized concrete slab pouring applications. The powered rotational screed apparatus 10 is designed generally to facilitate the finishing process in relation to the formation of concrete slabs. In the accomplishment of this process, the powered rotational screed apparatus 10 may be deployed on a slab pour site in a manner so that its screed roller 12 comes into contact with both the upper surfaces of the concrete forms 14 and the unfinished concrete 16 contained therein. This is accomplished by placing the screed roller 12 between the concrete forms 14 and over the area where the slab is to be formed.

One end or end portion of the screed roller 12 is rotationally attached to a drive assembly 20 and the other end or end portion to a pull device 22 (e.g., a handle) of any appropriate type (e.g., a strap, rope, or the like). The drive assembly 20 is the component of the powered rotational screed apparatus 10 that houses a drive motor 24, which in turn provides the rotational power to operate the powered rotational screed apparatus 10 (more specifically to rotate the screed roller 12). The drive motor 24 is fixed within the drive assembly 20 by the use of a motor frame 36, that also provides the point of fixed attachment for a handle assembly 26. The handle assembly 26 extends upward through an extension bar 28 from the motor frame 36 to position a control grip or handle 30 and a pull grip or handle 32 in a position so that the entire handle assembly 26 can be easily controlled by an operator. Finally, the power to the drive motor 24 is supplied through a power cord 42 by way of the control handle 30. The drive motor 24 may also be powered by an appropriate "on board" battery, an internal combustion engine (not shown), or any other appropriate power source.

The other end, or the non-powered or non-driven end, of the screed roller 12 (e.g., the end of the screed roller 12 that is opposite of the end where rotational power is input to the screed roller 12) provides the point of attachment for the pull device 22 through the operation of a pull bearing assembly 84. The pull bearing assembly 84 operates to isolate the pull device 22 from the rotational aspects of the screed roller 12, allowing it to be interconnected to the pull device 22 while allowing the screed roller 12 to rotate relative to the pull device 22. The nature and manner of operation of the pull bearing assembly 84 will be addressed in more detail below in relation to FIG. 8.

Additionally, the handle assembly 26 of the powered rotational screed apparatus 10 may be equipped with a pivotally mounted stand 34. The stand 34 allows the drive assembly 20 to be left in an upright position when not in use so that the control and pull handles, 30 and 32, respectively, are in an easily accessible location. When not in use, the pivotal attachment of the stand 34 allows it to be pivoted or rotated up next to the extension bar 28 so that it is not in the way during the operation of the handle assembly 26.

To perform the finishing or screeding operation, the drive motor 24 is engaged by the use of the control handle 30, which in turn powers the screed roller 12. As the screed roller 12 spins, the operator of the drive assembly 20 and the operator of the pull device 22 move the powered rotational screed apparatus 10 in a direction that is opposite to the rotation of the screed roller 12 over the unfinished concrete 16. This action has been found to be effective in producing the desired finish on the upper surface of the finished or screeded concrete 18, while also causing the concrete to compact to a desired consistency.

Figure 4:
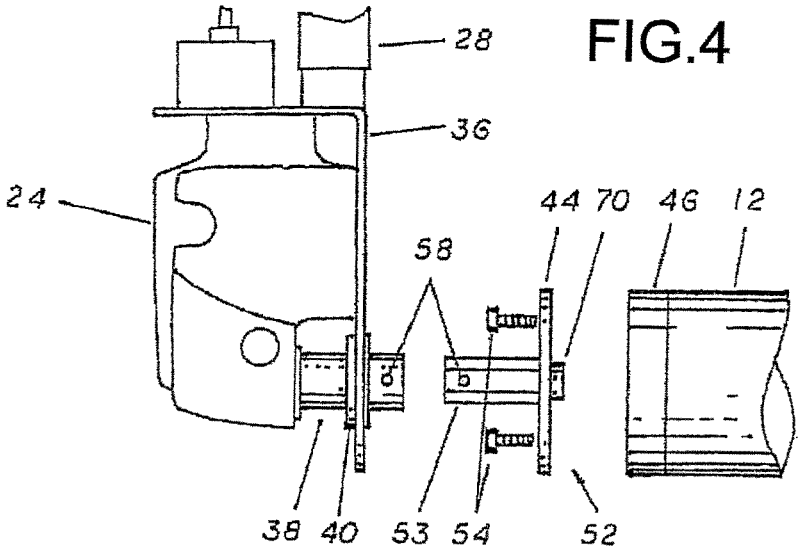
FIG. 4 is a front elevation, exploded view of drive motor and drive plate assembly components of the rotational drive assembly of FIG. 2, illustrating the manner by which they may engage the screed roller.

The output of the drive motor 24 is configured so that it can be fitted to a drive socket 38, which may be of a common 6-point impact type as illustrated in FIG. 4. As the drive socket 38 passes through the motor frame 36, the drive socket 38 is encased by a socket bearing 40. The socket bearing 40 allows the drive socket 38 to spin with the drive motor 24, while securely holding it within the stationary motor frame 36.

The use of the drive socket 38 allows for the securement of a drive plate assembly 52, which in turn bolts to the proximal end of the screed roller 12. To facilitate this, the drive plate assembly 52 is equipped with a rearwardly extending hexagonal shaft 53 that is specifically designed to engage the internal surface of the drive socket 38. Additionally, each of these components has an attachment pin hole 58. The attachment pin holes 58 allow for the passage of an attachment pin or the like (not shown) through the drive socket 38 and hexagonal shaft 53 to secure the two together (such that they collectively rotate).

The drive plate assembly 52 also has a circular drive plate 44 that may be of the same outside diameter as the screed roller 12. The drive plate 44 allows for the attachment of the drive plate assembly 52 to the screed roller 12 through the use of a plurality of bolts 54 or other suitable fasteners. Additionally, the distal surface of the drive plate 44 is equipped with a centrally located male shoulder 70 that operates to center a female attachment plug 46 of the screed roller 12 with reference to the drive plate assembly 52. This configuration not only transfers the rotational power of the drive motor 24 to the screed roller 12, but also ensures that all of the operational components are properly aligned.

Figure 5:
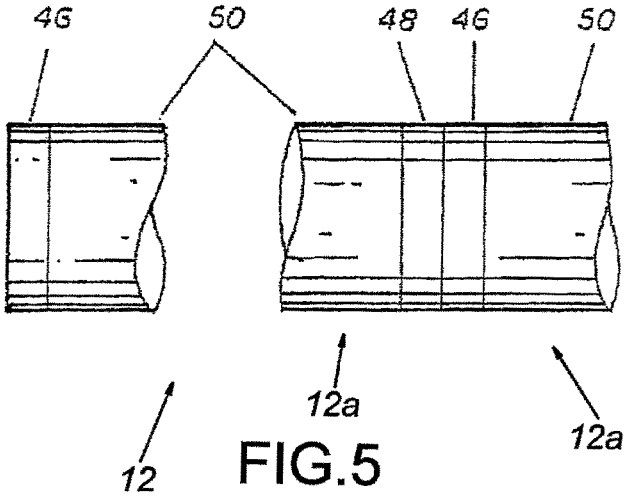
FIG. 5 is a front elevation view of a screed roller for the powered roller screed of FIG. 1, illustrating its general manner of construction and a way two or more individual screed roller sections can be joined together to form a longer screed roller.
Figure 6:
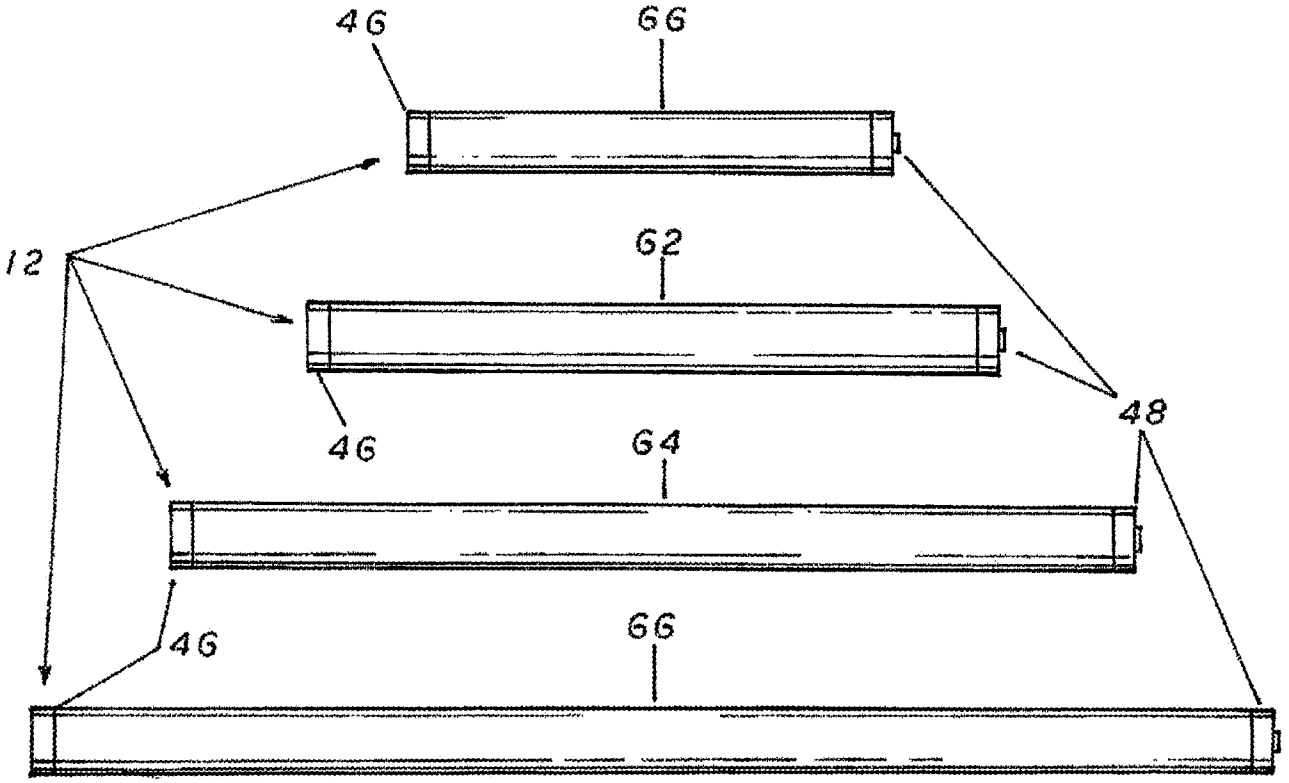
FIG. 6 is a front elevation view of a plurality of screed rollers, illustrating the varying lengths in which they can be constructed.

The screed roller 12 is the elongated cylindrical component of the powered rotational screed apparatus 10 that performs the finishing or screeding operation, and may be defined by connecting one or more screed roller sections 12*a* in end-to-end relation. The external manner of construction of the screed roller 12 is illustrated in FIGS. 5 and 6. Each screed roller section 12*a* is made up of three primary components. The first of these is a tube body 50, which is a tube of the desired inside and outside diameter and may be generally composed of a high strength aluminum alloy, although the use of other materials for this purpose is possible. Aluminum may be used in this application due to its desirable strength-to-weight ratio. The other components of an individual screed roller section 12*a* are a female and male attachment plug, 46 and 48, respectively, disposed on the opposite ends of the tube body 50. The screed roller sections 12*a* may be provided in a variety of different lengths.

The female and male attachment plugs, 46 and 48, are relatively short cylindrical components having a shoulder of a common outside diameter of the tube body 50 and an engagement body that has an outside diameter that is equal to the inside diameter of the tube body 50. Each screed roller section 12*a* is formed by fixedly attaching one female attachment plug 46 and one male attachment plug 48 to the opposite ends of the tube body 50. This forms a complete unit that is then capable of being used individually or in conjunction with another screed roller section 12*a* as will be described in greater detail below.

The above-described method of constructing a screed roller section 12*a* provides a means by which the powered rotational screed apparatus 10 can be adapted to match the width of a wide variety of possible concrete pours. This is facilitated by the building of screed rollers 12 of varying lengths by joining together two or more individual screed roller sections 12*a* (again, another option is to use a single screed roller section 12*a* for the screed roller 12). This design allows for the construction of screed rollers 12 of varying lengths as illustrated by screed rollers, 60, 62, 64, and 66 (the individual screed roller sections 12*a* not being shown in FIG. 6). Additionally, it must be stated that the lengths of the screed rollers as shown is intended to be for illustrative purposes only, and the construction of a screed roller of any usable length is possible.

Figure 7:
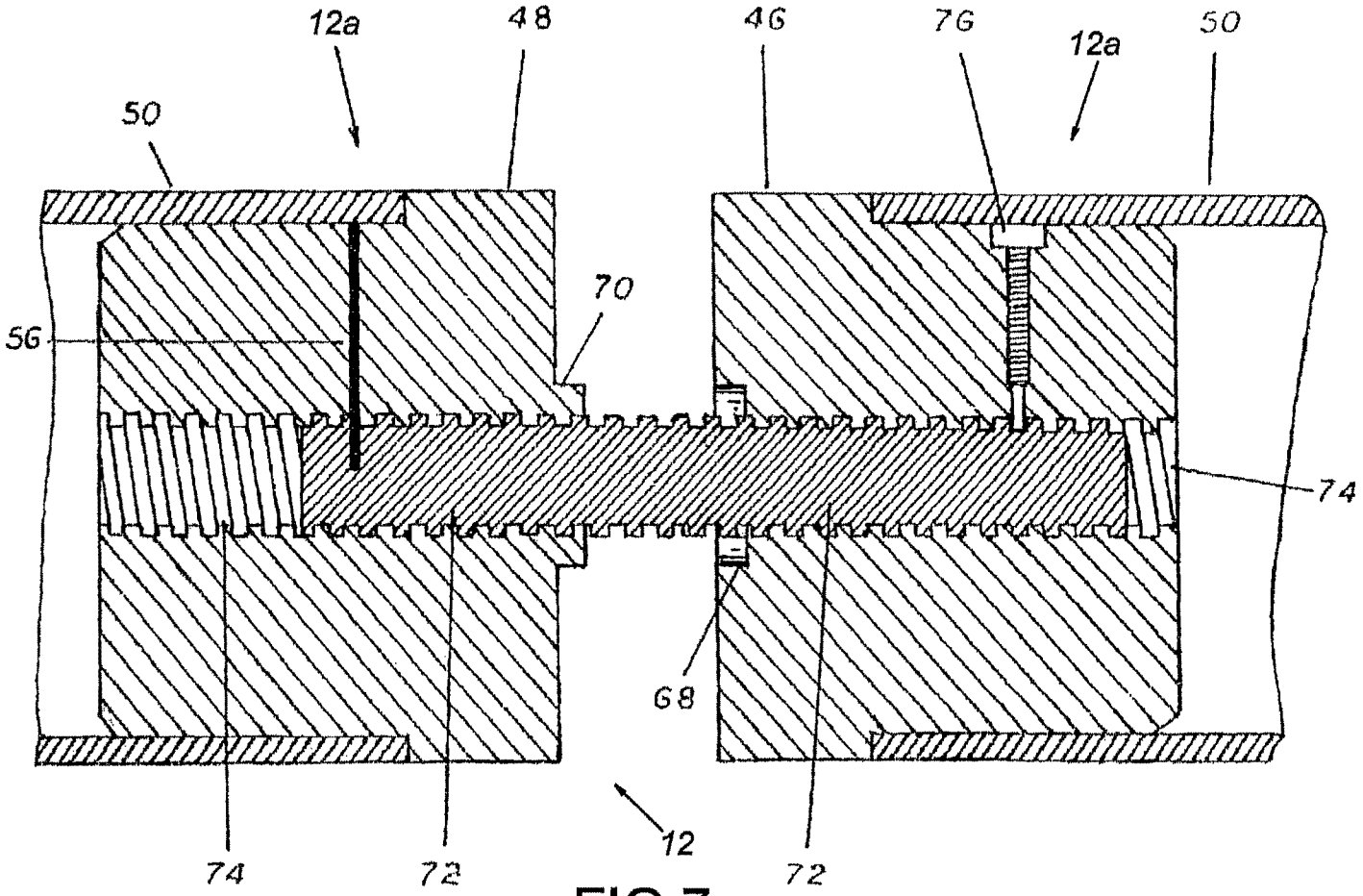
FIG. 7 is a cross-sectional view of a connection between two adjoining individual screed roller sections.

The female and male attachment plugs, 46 and 48, also contain a threaded hole 74 that passes longitudinally through their respective centers as illustrated in FIG. 7. The threaded hole allows 74 for the placement of a threaded rod 72 in a position so that it extends out beyond the outside end of the male attachment plug 48 to which it is fixedly attached. This attachment is accomplished by passing an attachment pin 56 through the body of the male attachment plug 48 in a manner so that it engages the threaded rod 72. In this configuration, the attachment pin 56 is retained within the male attachment plug 48, even when the screed roller 12 is disassembled.

The female attachment plug 46 is designed with a centrally located, with respect to its longitudinal axis, female recess 68 that extends into its body at the initial segment of its threaded hole 74. Conversely, the male attachment plug 48 is designed with a similarly positioned male shoulder 70 that fits within the female recess 68 of the female attachment plug 46 of an adjacent screed roller section 12*a*. Thus, the threaded rod 72, the female recess 68, and the male shoulder 70 components of the female and male attachment plugs, 46 and 48, provide a means by which two or more screed roller sections 12*a* can easily and securely be connected to one another to define a screed roller 12. Finally, once the proper connection has been accomplished through the described methods, the female attachment plug 46 can be locked in place with reference to the threaded rod 72. This may be accomplished by the use of a securement bolt 76 that passes through the body of the female attachment plug 46 to engage the surface of the threaded rod 72. The head of the securement bolt 76 may be accessible on an exterior of the screed roller 12.

The connection of two or more screed roller sections 12*a* is then simply accomplished by connecting the desired screed roller sections 12*a* by the use of the threaded rod 72 and threaded hole 74 and their associated components. Also, this design provides a means of attaching additional components that may be used in conjunction with the screed roller 12.

Figure 8:
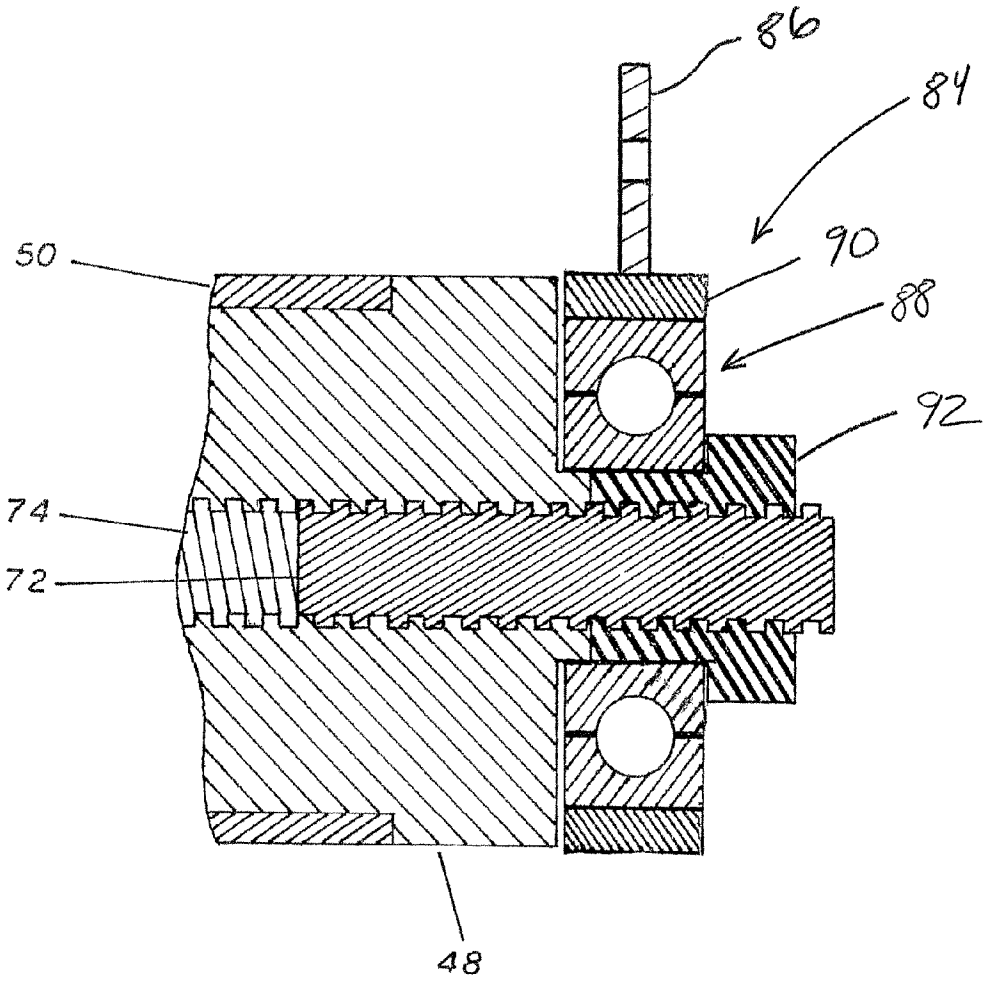
FIG. 8 is a cross-section view of one embodiment of pull bearing assembly detachably connected to an end of a screed roller.

As noted, a pull bearing assembly 84 may be attached to the non-powered or non-driven end of the screed roller 12 (and/or may be incorporated at an intermediate location along the length of the screed roller 12, for instance a bearing assembly 84 could be located between a pair of screed roller members 12*a* that are secured together in the above-noted manner (e.g., where the threaded rod 70 of the male attachment plug 48 of one screed roller section 12*a* would first extend through a hollow interior portion of the bearing assembly 84 and would then mate with the female attachment plug 46 of the adjacent screed roller section 12*a* in the noted manner)). Such a pull bearing assembly 84 rotationally isolates a pull device or handle 22 from the screed roller 12, yet still allows the handle 22 to be used to exert a pulling force on the screed roller 12. One embodiment of such a pull bearing assembly 84 is illustrated in FIG. 8. Generally, the pull bearing assembly 84 includes an outer bearing body 90 that is isolated from the remaining components by a bearing 88 (e.g., the outer bearing body 90 is not required to rotate with the inner race of the pull bearing assembly 84; ball bearings of the pull bearing assembly 84 are able to move relative to the outer bearing body 90). The outer bearing body 90 may also equipped with a mounting flange or pull ring 86 that allows for the attachment of an external, rotationally stationary device to the screed roller member 12 (e.g., handle 22). A nut 92 may be threaded onto the threaded rod 72 at the end of the screed roller 12 to secure the pull bearing assembly 84 to the screed roller 12. The outer bearing body 90 may include an end wall, and the nut 92 could be recessed (inwardly) relative to this end wall (not shown).

Figure 9:
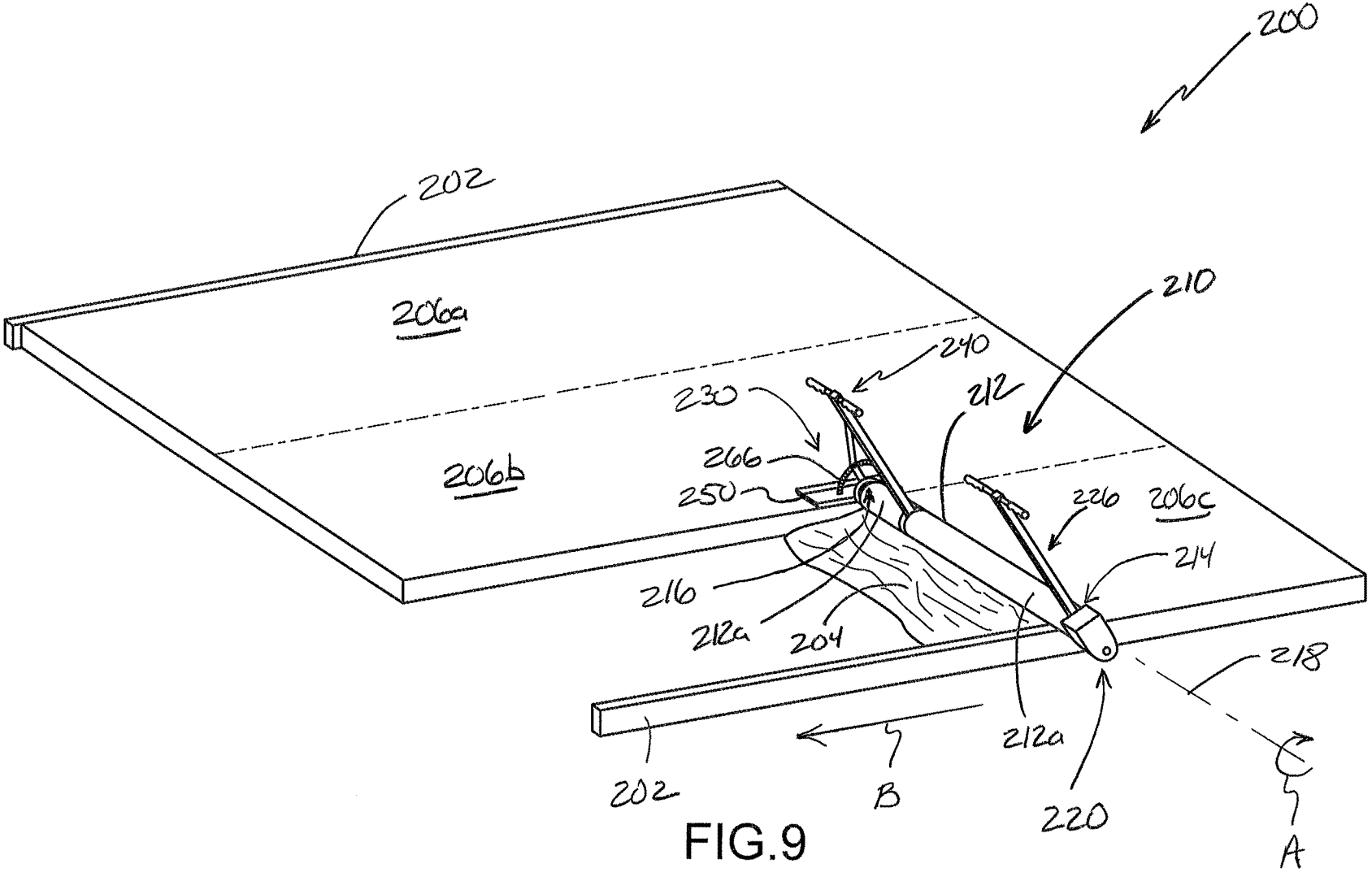
FIG. 9 is a perspective view of a concrete pour site and an embodiment of a powered roller screed that incorporates a wet screed assembly.

One embodiment of a concrete pour site is illustrated in FIG. 9 and is identified by reference numeral 200. The concrete pour site 200 utilizes a pair of concrete forms 202. These concrete forms 202 are spaced from one another by a distance such that multiple passes of a powered roller screed would be required to screed recently poured or wet concrete 204 (concrete that is still sufficiently viscous such it may be "shaped," such as "flattened" or screeded) that is disposed in the space between the concrete forms 202. FIG. 9 illustrates a first screeded section 206*a* (where wet concrete 204 has already been screeded), a second screeded section 206*b* (where wet concrete 204 has already been screeded), and the start of a third screeded section 206*c* for the concrete pour site 200. Wet concrete 204 (and not yet screeded) is positioned "behind" the third screeded section 206*c*. Typically the second screeded section 206*b* would be defined before the first screeded section 206*a* has sufficiently cured, such that the upper surface of the first screeded section 206*a* could still be modified while forming the second screeded section 206*b*. Similarly, typically the third screeded section 206*c* would be defined before the second screeded section 206*b* has sufficiently cured, such that the upper surface of the second screeded section 206*b* could still be modified while forming the third screeded section 206*c*.

Each screeded section 206*a-c* from the concrete pour site 200 of FIG. 9 is defined by a single pass of a powered roller screed. Any number of screeded sections may define the spacing between the forms 202 for the concrete pour site 200. Although each of the screeded sections 206*a*-206*c* is illustrated as being of the same width, this may not be the case for all possible configurations of concrete pour sites 200. In addition, although the concrete pour site 200 could be a horizontal surface, the concrete pour site 200 could also be inclined at any appropriate angle (e.g., a flat surface that is disposed at a certain angle or pitch, such as a concrete pour site associated with a highway overpass or the like).

One embodiment of a powered roller screed is also illustrated in FIG. 9, is identified by reference numeral 210, and in its illustrated form may be used to define both the second screeded section 206*b* and the third screeded section 206*c* of the concrete pour site 200. The powered roller screed 210 includes an appropriate rotational drive assembly 220 (e.g., drive assembly 20 discussed above) that is rotationally interconnected with an appropriate screed roller 212 (e.g., screed roller 12)—the drive assembly 220 rotates the screed roller 212 during screeding operations. The drive assembly 220 may be of any appropriate size, shape, configuration, and/or type (e.g., in accordance with the drive assembly 20 discussed above). The drive assembly 220 may include any appropriate drive source (e.g., an electric motor, a gasoline engine), may incorporate a handle or handle assembly 226 to allow an operator to grasp the same to pull on or otherwise manipulate the screed roller 212 during screeding operations, and may be interconnected with the screed roller 212 in any appropriate manner to rotate the same. The handle 226 may include a hand-operated throttle to control the rotational speed of the screed roller 212 (although such may not be required in all instances).

The screed roller 212 of the powered roller screed 210 is defined by at least two screed roller sections 212*a* in the illustrated embodiment (one screed roller section 212*a* being located between another handle or assembly 240 and a screed shoe 250 of a wet screed assembly 230 (discussed below); the portion of the screed roller 212 between the wet screed assembly 230 and the rotational drive assembly 220 may be defined by one or more screed roller sections 212*a* (only one shown in the illustrated embodiment)). Each screed roller section 212*a* used by the screed roller 212 may in accordance with the screed roller sections 12*a* of the screed roller 12 addressed above. Generally, multiple screed roller sections 212*a* may be interconnected in end-to-end relation in any appropriate manner to collectively define the screed roller 212. Although multiple screed roller sections 212*a* may be interconnected in the above-noted manner to define the screed roller 212 (e.g., by each screed roller section having a threaded male end and an oppositely disposed threaded female end), multiple screed roller sections could be interconnected in any appropriate manner to define the screed roller 212. Generally, the screed roller 212 may be of any appropriate size, shape, configuration, and/or type to provide a roller screeding function.

As noted, the powered roller screed 210 incorporates both a rotational drive assembly 220 and a wet screed assembly 230 that are spaced along the length dimension of the screed roller 212 (where this length dimension coincides with a rotational axis 218 of the screed roller 212). The rotational drive assembly 220 may be characterized as being associated with a driven end 214 of the screed roller 212, while the wet screed assembly 230 may be characterized as being associated with a non-driven end 216 of the screed roller 212. The rotational drive assembly 220 may be located at least generally at the driven end 214 of the screed roller 212, and the wet screed assembly 230 (more specifically its screed shoe 250) may be located at least generally at the non-driven end 216 of the screed roller 212.

The wet screed assembly 230 is also illustrated in FIGS. 10-13, and generally includes a handle or handle assembly 240 and a screed shoe 250. The handle 240 includes a handle extension 242 that is interconnected with and that extends away from the screed roller 212. In the illustrated embodiment, a pull bearing assembly 232 (e.g., in accordance with the pull bearing 84 discussed above) is disposed between an adjacent pair of screed roller sections 212*a* of the screed roller 212 that are detachably connected together. This pull bearing assembly 232 includes a pull bearing ring or flange 234 that is rotationally isolated from the screed roller 212. The handle extension 242 may be interconnected with this pull bearing ring 234 in any appropriate manner (e.g., detachably, using one or more appropriate fasteners). As the pull bearing ring 234 is rotationally isolated from the screed roller 212, the handle extension 242 is likewise rotationally isolated from the screed roller 212. That is, rotation of the screed roller 212 is not transmitted to the handle 240 in the case of the powered roller screed 210. Moreover, the handle 240 may be moved at least generally about the rotational axis 218 of the screed roller 212 (and also relative to the screed roller 212) to change the orientation/position of the handle 240 in a manner that will be discussed in more detail below.

The handle 240 includes a single gripping section 244 that is disposed on an end of the handle extension 242 that is opposite of that which interfaces with the noted pull bearing ring 234. This gripping section 244 may be configured to allow a single operator to use both hands to manipulate the non-driven end 216 of the screed roller 212. Further details regarding the gripping section 244 are addressed below.

A handle bracket 246 extends between the handle 240 (more specifically the handle extension 242) and another pull bearing assembly 232 that is located at or near the non-driven end 216 of the screed roller 212. As such, a single gripping section 244 directly acts upon two displaced locations of the screed roller 212 (at the two pull bearing assemblies 232 used by the wet screed assembly 230). The handle bracket 246 may be characterized as including three handle bracket sections 246*a-c*. The handle bracket section 246*a* may be interconnected with or mounted to the handle extension 242 of the handle 240 in any appropriate manner (e.g., detachably using one or more appropriate fasteners).

The handle bracket section 246*c* of the handle bracket 246 extends from the pull bearing flange 234 of the pull bearing assembly 232 that is located at or near the non-driven end 216 of the screed roller 212, and may be interconnected with or mounted to this pull bearing ring 234 in any appropriate manner (e.g., detachably using one or more appropriate fasteners). As such, the handle bracket section 246*c* (and more generally the entire handle bracket 246) may be moved at least generally about the rotational axis 218 of the screed roller 212 (and also relative to the screed roller 212) when changing the orientation/position of the handle 240 relative to the screed shoe 250 in a manner that will be discussed in more detail below.

The handle bracket section 246*b* of the handle bracket 246 extends between the handle bracket sections 246*a*, 246*c*. In the illustrated embodiment, the handle extension 242 of the handle 240 at least initially extends away from the screed roller 212 in parallel relation to the handle bracket section 246*c*. As such, a single gripping section 244 of the handle assembly 240 may be used to exert a pair of commonly directed forces on the screed roller 212 (where the handle extension 242 is interconnected with the screed roller 212 via one pull bearing assembly 232, and where the handle bracket 246 is interconnected with the screed roller 212 via a different pull bearing assembly 232).

A single screed roller section 212*a* is located between the handle extension 242 (handle 240) and the handle bracket section 246*c* (handle bracket 246). In one embodiment, this screed roller section 212*a* has a length of at least about 2 feet (e.g., the handle section 242 may be separated from the non-driven end 216 of the screed roller 212 by a distance of at least about 2 feet). The gripping section 244 is thereby also spaced inwardly from the non-driven end 216 of the screed roller 212. As the handle 240 includes only a single gripping section 244, the entirety of each gripping section 244 of the handle 240 may be characterized as being spaced inwardly from the non-driven end 216 of the screed roller 212. Each gripping section 244 of the handle 240 (there only being one such gripping section 244) may be characterized as being located somewhere between the non-driven end 216 of the screed roller 212 and its driven end 214. The gripping section 244 of the handle 240 is closer to the non-driven end 216 of the screed roller 212 compared to the gripping section of every other handle that may be used by the powered roller screed 210 (e.g., the gripping section 244 of the handle 240 is closer to the non-driven end 216 of the screed roller 212 than a gripping section for the handle 226 that extends from the drive assembly 220).

The screed shoe 250 is positioned on or substantially adjacent to previously-screeded wet concrete when the powered roller screed 210 is screeding an adjacent section as will be discussed in more detail below. Parts of the screed shoe 250 include a forward end wall 252, a rear end wall 254, a bottom 256, and a pair of sidewalls 258. The bottom 256 and each of the sidewalls 258 extend between the forward end wall 252 and the rear end wall 254 of the screed shoe 250. The forward end wall 252 of the screed shoe 250 is the "leading" portion of the screed shoe 250 during screeding operations using the powered roller screed 210 (see FIG. 9, where the arrow B represents the direction in which the powered roller screed 210 is pulled when screeding wet concrete 204—concrete that has yet been screeded). Both the forward end wall 252 and the rear end wall 254 may be inclined surfaces or otherwise configured so as to not "dig" into the previously screeded wet concrete during a screeding operation with the powered roller screed 210.

A lower surface 256*a* of the bottom 256 of the screed shoe 250 will typically interface with a recently screeded section of wet concrete (e.g., concrete that has been screeded, but that has not yet cured or "hardened" to a significant degree) when using the powered roller screed 210 to screed an adjacent section of wet concrete 204. Typically one of the operators of the powered roller screed 210 will use the handle assembly 240 to manipulate the non-driven end 216 of the screed roller 212 so that the lower surface 256*a* of the screed shoe 250 will be positioned at least substantially flush with the recently screeded section, although the lower surface 256*a* could be disposed at least substantially parallel to and slightly spaced from the adjacent recently screeded section. As such, the lower surface 256*a* of the screed shoe 250 is preferably flat.

The screed shoe 250 may provide a visual guide to an operator during screeding operations. However the screed shoe 250 may also be used to support the adjacent end 216 of the screed roller 212, including to allow the screed roller 212 to "float" during screeding operations. In this regard, the lower surface 256*a* of the screed shoe 250 may have a surface area of at least about 120 in.$^2$ in one embodiment, of at least about 165 in.$^2$ in another embodiment, and of at least about 220 in.$^2$ in yet another embodiment. The length of the screed shoe 250 may be characterized as the spacing between the forward end wall 252 and the rear end wall 254, while the width of the screed shoe 250 may be characterized as the spacing between its pair of sidewalls 258. The length of the lower surface 256*a* of the screed shoe 250 may be at least about 20 inches in one embodiment, may be at least about 23 inches in another embodiment, and may be at least about 26 inches in yet another embodiment. The width of the lower surface 256*a* of the screed shoe 250 may be at least about 6 inches in one embodiment, may be at least about 7.25 inches in another embodiment, and may be at least about 8.5 inches in yet another embodiment.

The above-noted features relating to the sizing of the lower surface 256 may facilitate one or more aspects of a screeding operation. The screed shoe 250 includes additional features in this regard. As noted, the screed shoe 250 includes a pair of laterally spaced sidewalls 258 and a pair of longitudinally spaced end walls 252, 254 that each extend upwardly from the bottom 256 of the screed shoe 250. The sidewalls 258 may extend upwardly from the bottom 256 of the screed shoe 250 by a distance of at least about ¾ inch in one embodiment along the entire length of the screed shoe 250 (except where the "inner" sidewall 258 includes a cutout 260 for the screed roller 212), and by a distance of at least about 1 inch in another embodiment along the entire length of the screed shoe 250. The height of the two end portions of each of the sidewalls 258 (adjacent to the two end walls 252, 254) may be even higher, for instance at least 1.5 inches in one embodiment and at least about 2 inches in another embodiment. The upper edge of the two end walls 252, 254 of the screed shoe 250 may be vertically spaced from the bottom 256 by a distance of at least about 1.5 inches in one embodiment and by a distance of at least about 2 inches in another embodiment. This "perimeter wall" of the screed shoe 250 should reduce the potential for wet concrete collecting on the upper surface 256*b* of the bottom 256 for the screed shoe 250 during screeding operations. Moreover and as noted, each of the end walls 252, 254 may be ramped, inclined or otherwise shaped so as to reduce the potential of the screed shoe 250 "digging in" during screeding operations, to facilitate "floating" of the screed shoe 250 during screeding operations, or both.

A bearing assembly 280 is mounted to the bottom 256 of the screed shoe 256 in any appropriate manner (e.g., detachably using one or more suitable fasteners). The non-driven end 216 of the screed roller 212 is rotatably supported by this bearing assembly 280, which may be disposed midway between the sidewalls 258 of the screed shoe 250. One of the sidewalls 258 of the screed shoe 250 (the one that is closest to the driven end 214 of the screed roller 212) includes a cutout 260 such that the screed roller 212 may extend to the bearing assembly 280. An end portion of a cylindrical body 213 of the screed roller 212 (the portion of the screed roller 212 that contacts the wet concrete 204 during screeding operations) actually extends over a portion of the bottom 256 of the screed shoe 250. The cylindrical body 213 of the screed roller 212 is preferably disposed in closely spaced relation to an upper surface 256*b* of this bottom 256, including by a spacing of no more than about ⅛ inch in one embodiment and by a spacing of no more than about 1/16 inch in another embodiment.

The screed shoe 250 is rigidly interconnected with the handle 240 (the handle extension 242 and the gripping section 244). In this regard, the screed shoe 250 includes a pair of mounting flanges 262 that are each appropriately secured relative to the bottom 256 and/or sidewalls 258 (e.g., welding, brazing) of the screed shoe 250. Each mounting flange 262 may be disposed at least generally orthogonal to the length dimension of the screed shoe 250, may extend between the pair of sidewalls 258 of the screed shoe 250, or both. The mounting flanges 262 provide at least a degree of rigidity to the screed shoe 250 at least in the lateral or width dimension. Moreover, the mounting flanges 262 are used to rigidly interconnect the handle assembly 240 with the screed shoe 250.

A screed shoe bracket 266 is appropriately secured to both mounting flanges 262, and as such the screed shoe bracket 266 may be characterized as being mounted to the screed shoe 250. In the illustrated embodiment, the screed shoe bracket 266 is detachably connected to each of the mounting flanges 262 using one or more suitable fasteners (e.g., a nut/bolt arrangement, a locking pin (alone or in conjunction with locking wire, clip, or clasp), or the like). In this regard, each of the mounting flanges 262 may include one or more mounting holes 264 for use in the mounting of the screed shoe bracket 266 thereto, and the screed shoe bracket 266 may include a mounting section 272 with corresponding holes 274.

The position of the screed shoe bracket 266 relative to the screed shoe 250 and/or screed roller 212 is subject to a number characterizations. The screed shoe bracket 266 may be described as extending from a rearward location of the screed shoe 250 (e.g., between the bearing assembly 280 and the rear end wall 254 of the screed shoe 250) to a forward location of the screed shoe 250 (e.g., between the bearing assembly 280 and the forward end wall 252 of the screed shoe 250). One end of the screed shoe bracket 266 is thereby disposed on each side of the screed roller 212 when secured to the two mounting flanges 262. The screed shoe bracket 266 may be characterized as extending at least generally in the length dimension of the screed shoe 250 in progressing from one end of the screed shoe bracket 266 (at one mounting flange 262) to the opposite end of the screed shoe bracket 266 (at the other mounting flange 262). The screed shoe bracket 266 may progress along an arc proceeding between its two ends (one end at each mounting flange 262), including along a semi-circular path. In one embodiment, the screed shoe bracket 266 is semicircular in progressing between its two opposing ends (one end at each mounting flange 262) and the center of this semi-circular screed shoe bracket 266 is located along the rotational axis 218 of the screed roller 212.

The screed shoe bracket 266 also includes an adjustment section 268. In the illustrated embodiment, the adjustment section 268 and the above-noted mounting section 272 of the screed shoe bracket 266 are disposed at least generally perpendicular to one another (e.g., the screed shoe bracket 266 may be characterized as having an at least generally L-shaped cross-section). Other shapes/relative orientations may be appropriate.

The adjustment section 268 of the screed shoe bracket 266 includes a plurality of adjustment holes 270. Any appropriate number of adjustment holes 270 may be utilized. Although the adjustment holes 270 are shown as being equally spaced, such may not be required in all instances. Generally, the various adjustment holes 270 of the screed shoe bracket 266 provide for disposing the handle 240 in a number of different orientations relative to the screed shoe 250 (more specifically its flat lower surface 256*a*), while still allowing the handle 240 to remain rigidly coupled with the screed shoe 250.

The adjustment holes 270 for the screed shoe bracket 266 are subject to a number of different characterizations. The adjustment holes 270 may be contained within a common reference plane, for instance a reference plane that is orthogonal to the rotational axis 218 of the screed roller 212. The screed shoe bracket 266 may be oriented such that each adjustment hole 270 occupies a different position along the length of the screed shoe 250. Each adjustment hole 270 may be located may be located the same distance from the rotational axis 218 of the screed roller 212 (e.g., via a semicircular configuration for the screed shoe bracket 266). Each adjustment hole 270 that is located in the span between the location of the rotational axis 218 of the screed roller 212 and the forward end wall 252 of the screed shoe 250 may be disposed at a different elevation relative to the lower surface 256*a* of the screed shoe 250. Each adjustment hole 270 that is located in the span between the location of the rotational axis 218 of the screed roller 212 and the rear end wall 254 of the screed shoe 250 may be disposed at a different elevation relative to the lower surface 256*a* of the screed shoe 250.

The handle bracket 246 is rigidly attached to the adjustment section 268 of the screed shoe bracket 266. Generally, the handle assembly 240 may be rotated into the desired angular position relative to the screed roller 212 and screed shoe 250 (moved at least generally about the rotational axis 218 of the screed roller 212; without the handle bracket 246 having yet been rigidly fixed or coupled to the screed shoe bracket 266). This will responsively move the third handle bracket section 246*c* of the handle bracket 246 relative to the adjustment section 268 of the screed shoe bracket 266. An appropriate fastener (e.g., a nut/bolt arrangement, a locking pin (alone or in conjunction with locking wire, clip, or clasp), or the like) may be directed through a hole 248 in the third handle bracket section 246*c* and then preferably through an aligned adjustment hole 270 of the screed shoe bracket 266 to rigidly connect or couple the handle bracket 246 to the screed shoe bracket 266 (and thereby the screed shoe 250).

Based upon the foregoing, it should be appreciated that the handle 240 is rigidly interconnected with the screed shoe 250. Motion of the handle 240 at least generally about the rotational axis 218 of the screed roller 212 (when the handle 240 is coupled to the screed show 250 in the noted manner) will correspondingly move the screed shoe 250 based upon the above-noted rigid connection between the handle 240 and the screed shoe 250 (e.g., via the handle bracket 246 that extends between and rigidly interconnects the handle 240 with the screed shoe bracket 266 (which in turn is fixed relative to the screed shoe 250)). The handle 240 may be manipulated by an operator during screeding operations in a manner that will correspondingly change the orientation of the screed shoe 250 (based upon the noted rigid connection between the handle 240 and the screed shoe 250). Maintaining the lower surface 256*a* of the bottom 256 of the screed shoe 250 in close proximity to or at least substantially flush with a previously-screeded concrete section should create a freshly-screeded section that is at least substantially coplanar with the adjacent and previously screeded section.

The angular position of the handle 240 relative to the screed roller 212 and/or the lower surface 256*a* of the screed shoe 250 may be adjusting prior to initiating screeding operations (and without changing the position/orientation the screed shoe 250 while this adjustment of the position of the handle 240 is made, namely by uncoupling the handle bracket 246 from the screed shoe bracket 266). For instance the handle 240 could be disposed in one angular position for one operator, and the handle assembly 240 could be disposed in a different angular position for a different operator (e.g., to accommodate for a height difference between these operators; to allow an operator to adjust the height of the gripping section 244 of the handle 240 for the operator's height and/or so as to be disposed in desired location for exerting a pulling force on the powered roller screed 210). In each instance the screed shoe 250 may thereafter be secured (relative to the handle 240) in at least generally the same orientation by simply using a different adjustment hole 270 of the screed shoe bracket 266 for purposes of securing the handle bracket 246 to the screed shoe bracket 266 (i.e., a rigid connection between the handle 240 and the screed shoe 250 may be provided, regardless of which adjustment hole 270 is used to fix the position of the handle 240 relative to the screed shoe 250; a rigid connection between the handle 240 and the screed shoe 250 may be provided, for each of a number of different positions of the handle 240 relative to the screed shoe 250).

The position of the handle 240 relative to the screed roller 212 and screed shoe 250 may be adjusted for any number of reasons. For instance, it may be desirable to have the handle 240 in one position relative to the screed shoe 250 for a horizontal concrete pour, and to have the handle 240 in a very different position relative to the screed shoe 250 for an inclined concrete pour (e.g., the handle extension 242 may be less inclined relative to the screed shoe 250 in the case of an inclined concrete pour versus a horizontal concrete pour). The powered roller screed 210 accommodates these different configurations or orientations for the handle 240, and yet in each such configuration/orientation, the handle 240 can be rigidly connected to the screed shoe 250 for enhanced control during screeding operations. As a rigid connection exists between the handle 240 and the screed shoe 250, the orientation of the screed shoe 250 provides an enhanced visual indication to an operator of the powered roller screed 210 for screeding operations.

Figure 14A:
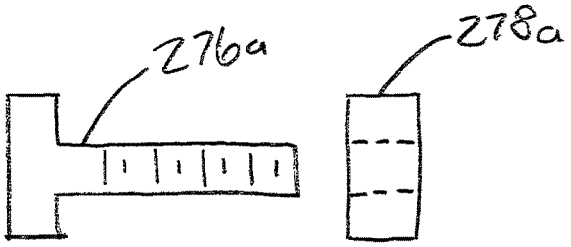
FIG. 14A is one embodiment of a fastener that may be used by the wet screed assembly for the powered roller screed of FIGS. 9-11.
Figure 14B:
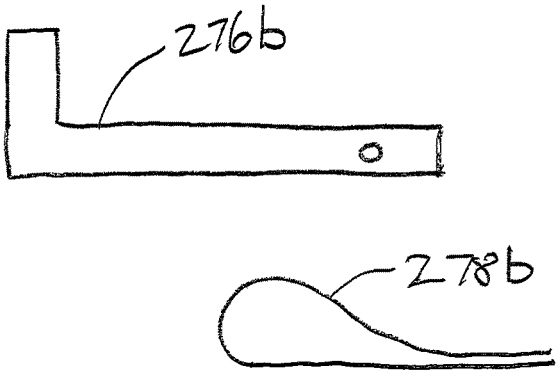
FIG. 14B is another embodiment of a fastener that may be used by the wet screed assembly for the powered roller screed of FIGS. 9-11.

Representative fasteners that may be used by the wet screed assembly 230 (e.g., to secure the handle bracket 246 to the screed shoe bracket 266; to secure the screed shoe bracket 266 to each of the mounting flanges 262) are illustrated in FIGS. 14A and 14B. FIG. 14A shows a threaded bolt 276*a* and a corresponding nut 278*a* having a threaded hole. FIG. 14B shows a locking pin 276*b* and a locking clip 278*b* that may be mounted to the locking pin 276*b* via a hole in the locking pin 276*b*.

Referring now back to FIG. 9, the illustrated configuration of the powered roller screed 210 may be used to define the second screeded section 206*b* (the wet screed assembly 230 would not be needed to define the first screeded section 206*a*—the screed roller 212 could be positioned directly on the concrete form 202 that borders this first screeded section 206*a*, and an appropriate handle (e.g., handle 240) could be secured to the pull bearing ring 234 that is adjacent to the non-driven end 216 of the screed roller 212—the screed shoe 250 could be removed in this instance). In the case of defining the second screeded section 206*b*, the screed shoe 250 may be positioned such that the bottom surface 256*a* of the screed shoe 250 is at least substantially flush with the upper surface of the first screeded section 206*a*. Based upon the configuration of the powered roller screed 210, an operator that is using the gripping section 244 of the handle assembly 240 will be comfortably spaced from the first screeded section 206*a* while defining the second screeded section 206*b* with the powered roller screed 210. A screed pole or the like (e.g., disposed at least generally parallel to the forms 202) may be positioned such that a different portion of the screed roller 212 (at least generally adjacent to the driven end 214) is positioned on and supported by this screed pole when defining the second screeded section 206*b* with the powered roller screed 210.

After the second screeded section 206*b* in FIG. 9 has been completed, the powered roller screed 210 may also be used to form the third screeded section 206*c* and in the manner shown in FIG. 9 (where the screed shoe 250 is now positioned on the upper surface of the second screeded section 206*b*, and where the screed roller 212 is positioned on and supported by the concrete form 202 that borders the third screeded section 206*c*). In all instances, the screed roller 212 is rotated in a direction that is opposite of that in which the screed roller 212 is pulled to provide a screeding function. Arrow A in FIG. 9 indicates the direction of rotation of the screed roller 212, while arrow B indicates the direction that the operators will pull on the powered roller screed 210 to screed wet concrete 204. It should be appreciated that at various times during a screeding operation, the operators of the powered roller screed 210 may allow the screed roller 212 to advance over recently screeded wet concrete prior to pulling the powered roller screed 210 over un-screeded concrete 204 (e.g., to allow the screed roller 212 to move directly opposite to the direction indicated by the arrow B and over recently screeded concrete in the screeded concrete section that is currently being formed).

Figure 10:
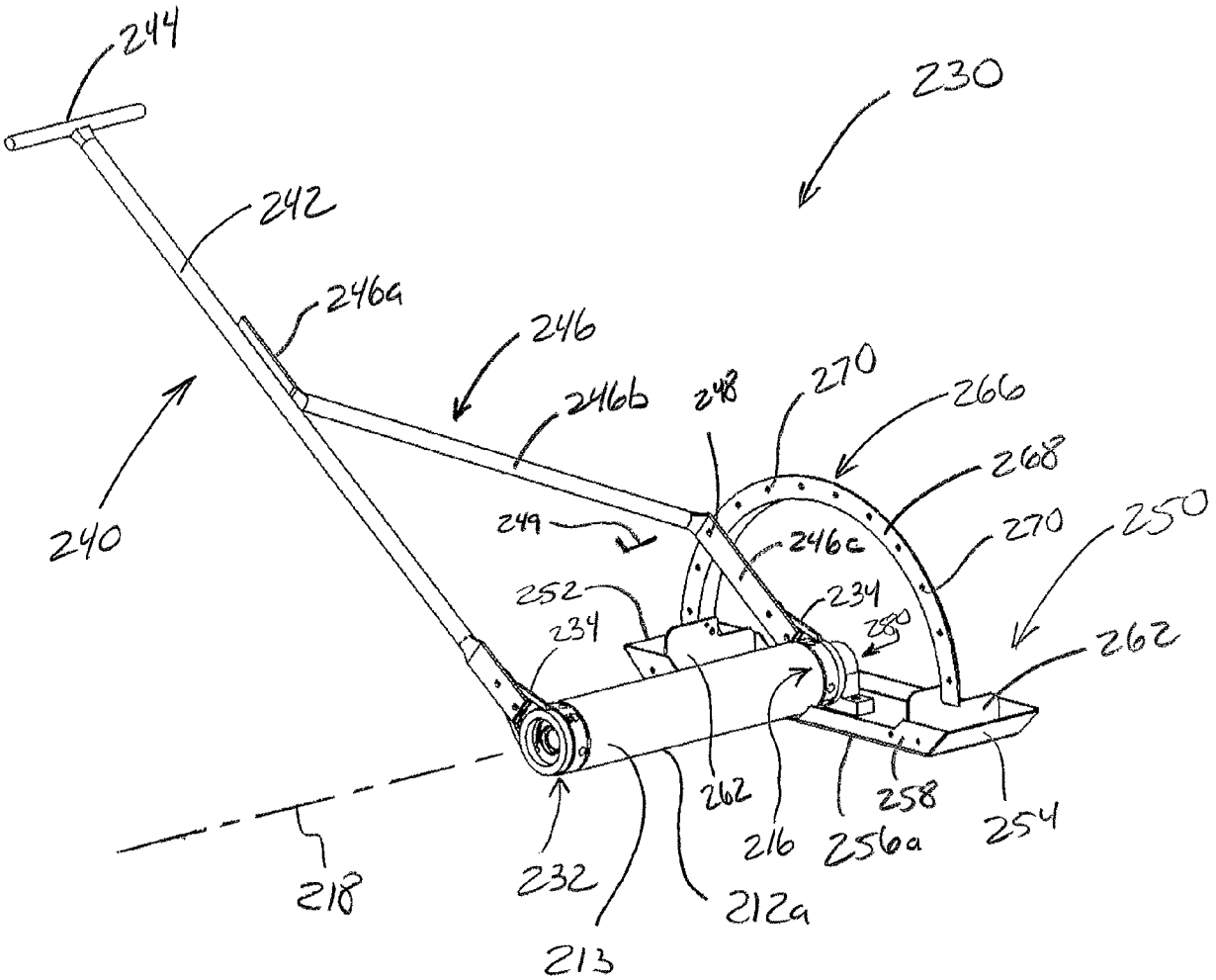
FIG. 10 is one perspective view of the wet screed assembly from the powered roller screed of FIG. 9.
Figure 11:
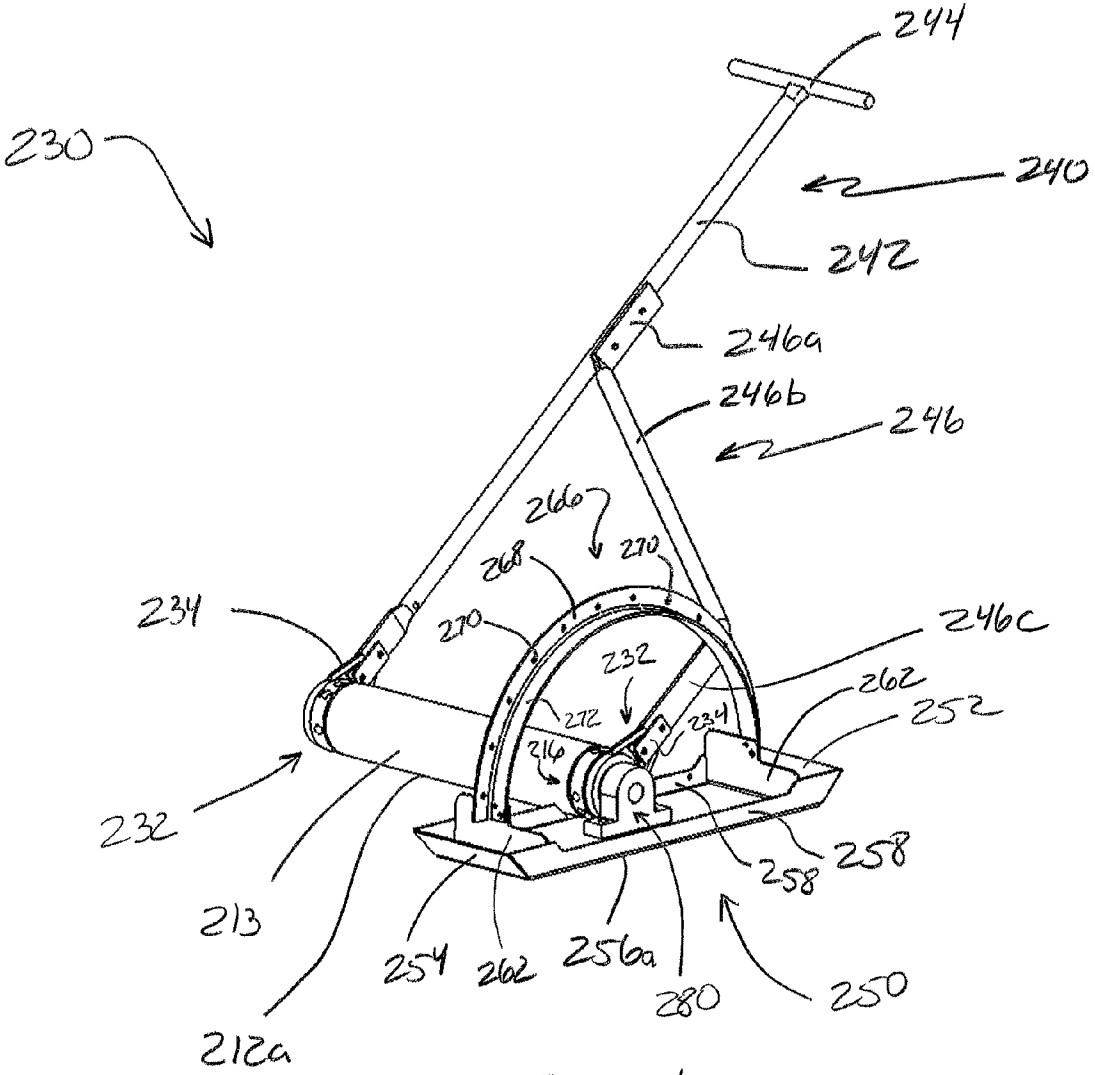
FIG. 11 is another perspective view of the wet screed assembly from the powered roller screed of FIG. 9.
Figure 12:
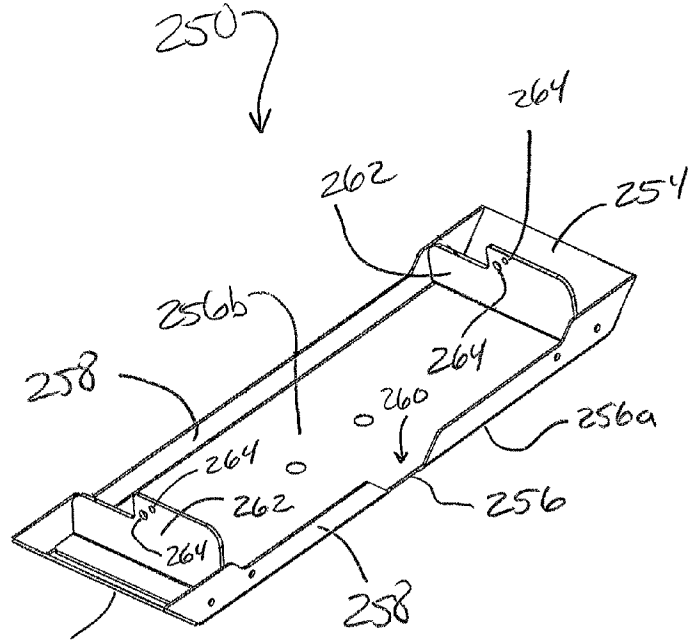
FIG. 12 is a perspective view of a screed shoe from the wet screed assembly used by the powered roller screed of FIGS. 9-11.
Figure 13:
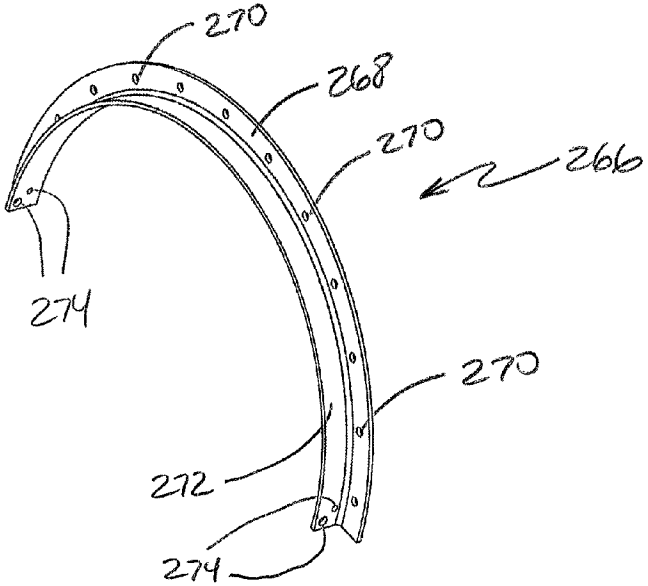
FIG. 13 is a perspective view of a screed shoe bracket from the wet screed assembly used by the powered roller screed of FIGS. 9-11.
Figure 15:
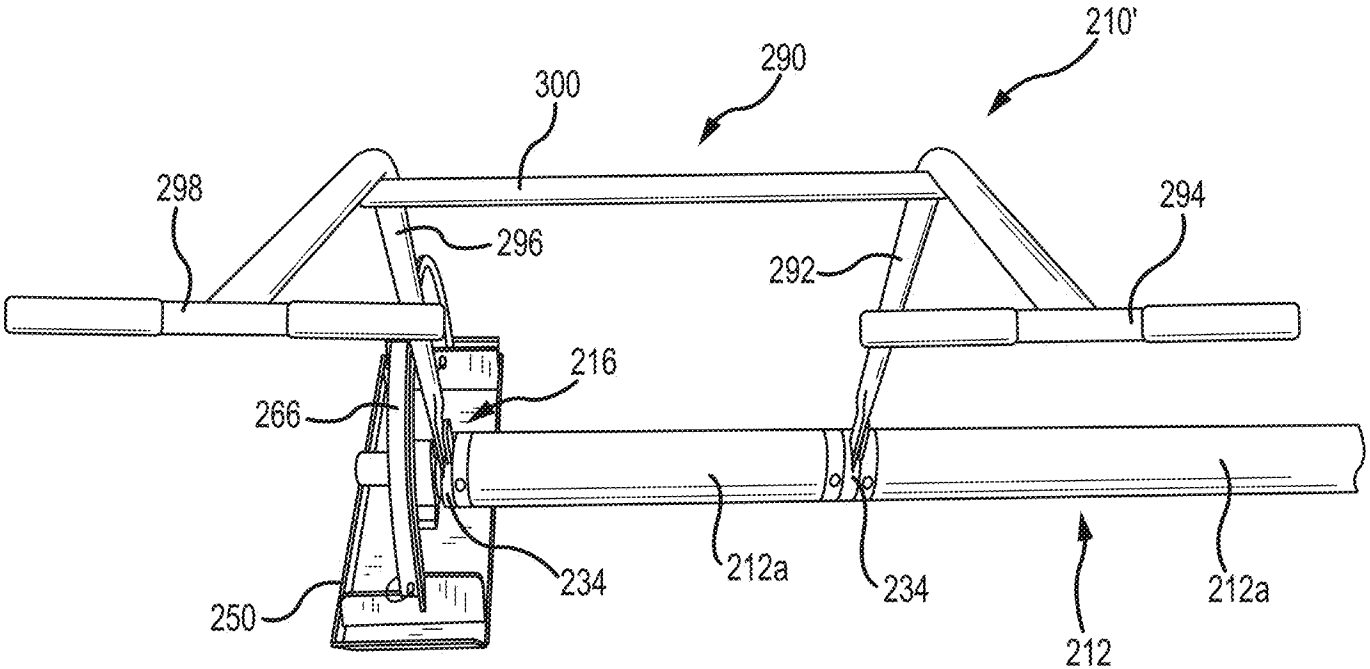
FIG. 15 is a front-based perspective view of a variation of a wet screed assembly that may be used by a powered roller screed.
Figure 16:
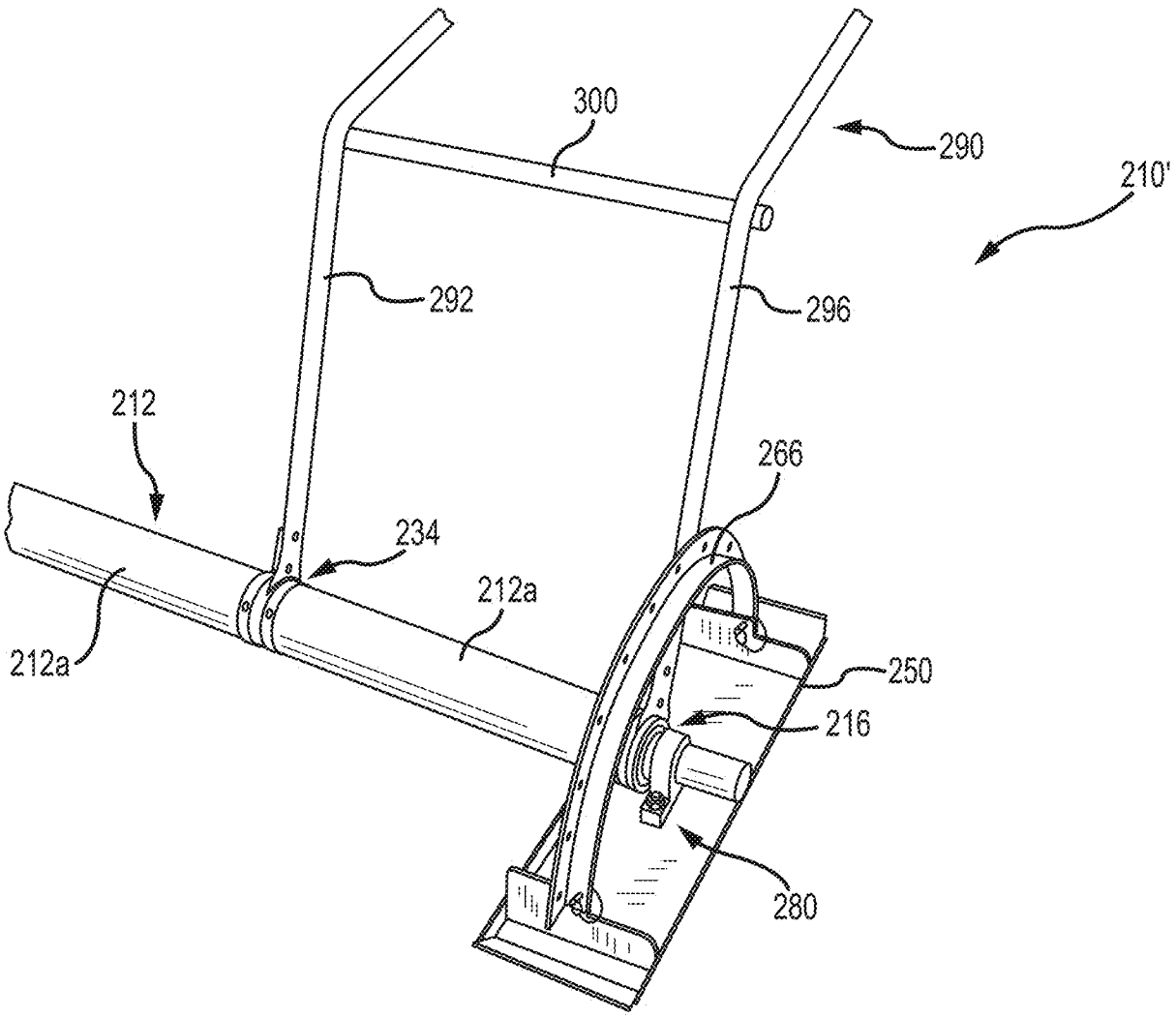
FIG. 16 is a rear-based perspective view of the wet screed assembly shown in FIG. 15.
Figure 17:
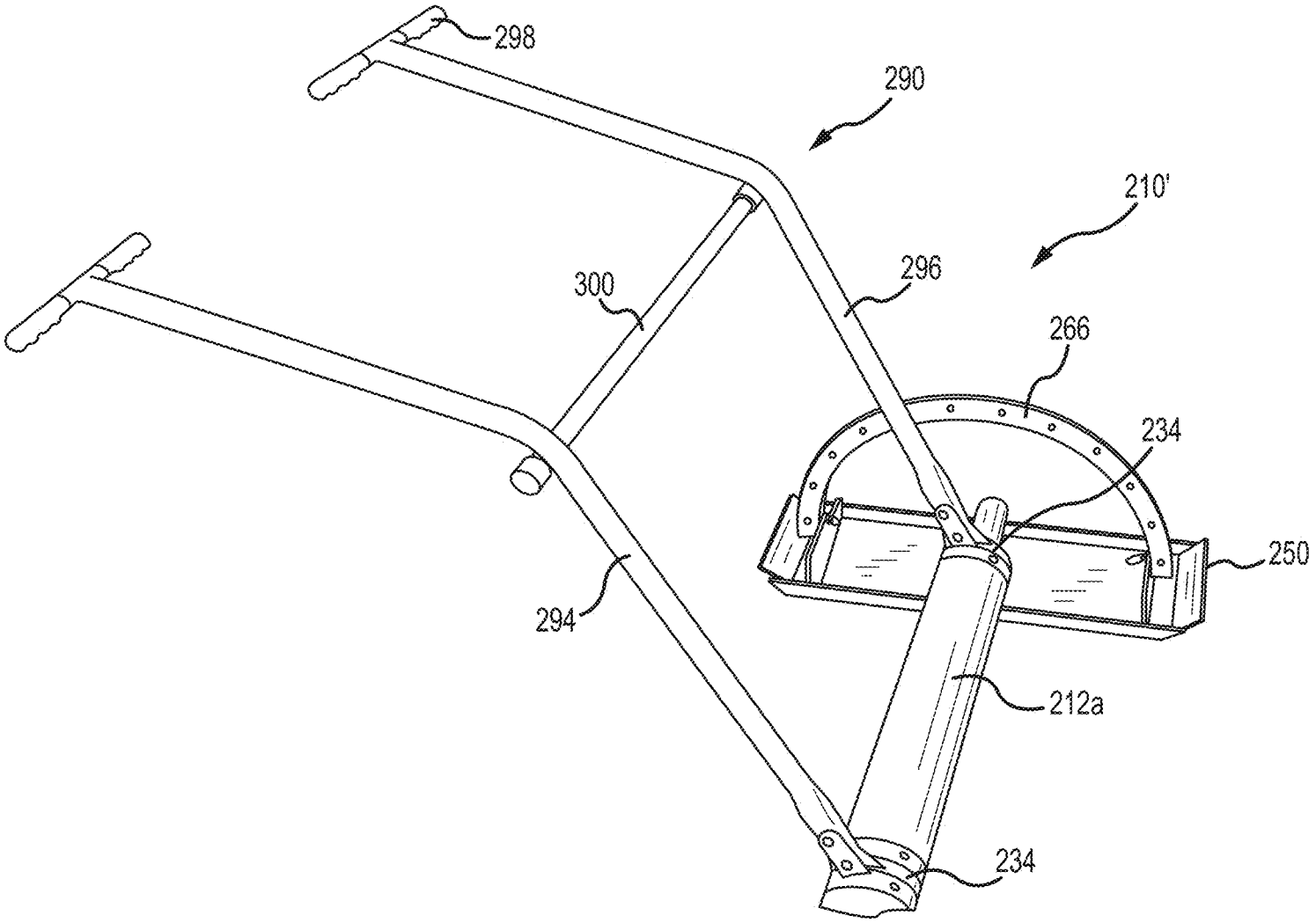
FIG. 17 is an end-based perspective view of the wet screed assembly shown in FIG. 15.

A variation of the powered roller screed 210 of FIGS. 9-11 is presented in FIGS. 15-17 and is identified by reference numeral 210'. Unless otherwise noted, the discussion of the powered roller screed 210 of FIGS. 9-11 is equally applicable to the powered roller screed 210' of FIGS. 15-17. The primary difference is that the powered roller screed 210' of FIGS. 15-17 replaces the handle 240 of the powered roller screed 210 with a handle or handle assembly 290.

The handle 290 for the powered roller screed 210' includes a first handle extension 292 that is mounted to and extends from the pull bearing assembly 232 that is spaced inwardly from the non-driven end 216 of the screed roller 212, along with a second handle extension 296 that is mounted to and extends from the pull bearing assembly 232 that is disposed at least generally adjacent to the non-driven end 216 of the screed roller 212. A first gripping section 294 is disposed on an end of the first handle extension 292, and a second gripping section 298 is disposed on an end of the second handle extension 296. As such, a screed roller section 212*a* in the case of the powered roller screed 210' is located between the first handle extension 292 and the second handle extension 296 of the handle 290.

A cross member 300 is rigidly secured to each of the first handle extension 292 and the second handle extension 296 in any appropriate manner. The second handle extension 296 may be mounted or coupled to the screed shoe bracket 266 by directing a suitable fastener (e.g., a bolt/nut arrangement; a pin and including a pin that may be locked in the installed position in any appropriate manner) through the second handle extension 296 and an aligned adjustment hole 270 of the screed shoe bracket 266.

In the case of the powered roller screed 210' of FIGS. 15-17, the position or orientation of the handle assembly 290 relative to the screed shoe 250 may be adjusted by uncoupling the second handle extension 296 from the screed shoe bracket 266, and thereafter collectively moving the first handle extension 292 and the second handle extension 296 at least generally about the rotational axis 218 of the screed roller 212 and relative to the screed roller 212. Once in the desired position, the second handle extension 296 may be coupled to the screed shoe bracket 266 in the above-noted manner (such that the handle assembly 290 is now rigidly coupled with the screed shoe 250). As such, the handle 294 of the powered roller screed 210' is rigidly coupled to the screed shoe 250 such that exerting a force on at least one of the gripping sections 294, 298 will be transmitted to the screed shoe 250 and will produce a corresponding change in position/orientation of the screed shoe 250. Changing the orientation of the first handle section 292 relative to the rotational axis 218 of the screed roller 212 and the surface being screeded will induce the same change in orientation for the second handle section 296 and the screed shoe 250. Similarly, changing the orientation of the second handle section 296 relative to the rotational axis 218 of the screed roller 212 and the surface being screeded will induce the same change in orientation for the first handle section 292 and the screed shoe 250.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed:

1. A cement screeding system, comprising:

a screed roller comprising first and second ends;

a first handle interconnected with said screed roller;

a drive assembly rotationally interconnected with said screed roller;

a wet screed shoe interconnected with said second end of said screed roller, wherein said wet screed shoe comprises a flat lower surface;

a screed shoe bracket mounted to and maintained in a fixed position relative to said wet screed shoe;

a second handle spaced from said first handle and that extends from a first bearing assembly incorporated by said screed roller;

a handle bracket that extends between said second handle and a second bearing assembly that is incorporated by said screed roller, wherein said first and second bearing assemblies are spaced along said rotational axis of said screed roller, wherein said handle bracket is detachably coupled with said screed shoe bracket, and wherein said screed roller is rotatable relative to each of said wet screed shoe, said first handle, said second handle, and said handle bracket;

a first screed shoe/handle configuration where said handle bracket is rigidly coupled with said screed shoe bracket at a first location and that disposes and maintains said second handle in a first fixed orientation relative to said wet screed shoe; and a second screed shoe/handle configuration where said handle bracket is rigidly coupled with said screed shoe bracket at a second location and that disposes and maintains said second handle in a second fixed orientation relative to said wet screed shoe, wherein said first and second fixed orientations are different from one another.

2. The cement screeding system of claim 1, wherein said screed shoe bracket comprises a plurality of adjustment holes which in turn comprises first and second adjustment holes, wherein said first adjustment hole is used for said first screed shoe/handle configuration, and wherein said second adjustment hole is used for said second screed shoe/handle configuration.

3. The cement screeding system of claim 2, wherein said plurality of adjustment holes is disposed within a reference plane that is perpendicular to said rotational axis of said screed roller.

4. The cement screeding system of claim 2, wherein each adjustment hole of said plurality of adjustment holes occupies a different position along a length of said wet screed shoe.

5. The cement screeding system of claim 2, wherein each adjustment hole of said plurality of adjustment holes is positioned the same distance from said rotational axis of said screed roller.

6. The cement screeding system of claim 2, wherein said plurality of adjustment holes comprises first and second sets of adjustment holes, wherein each adjustment hole in said first set is disposed at a different elevation relative to said lower surface of said wet screed shoe, and wherein each adjustment hole in said second set is disposed at a different elevation relative to said lower surface of said wet screed shoe.

7. The cement screeding system of claim 2, further comprising:

a fastener that extends through said handle bracket and that is positioned within one of said plurality of adjustment holes to rigidly maintain said second handle in a fixed position relative to said wet screed shoe.

8. The cement screeding system of claim 1, wherein said screed roller comprises a plurality screed roller sections that are threadably connected together in end-to-end relation, wherein said plurality of screed roller sections comprises said first and second screed rollers that are disposed on opposite sides of said first bearing assembly.

9. The cement screeding system of claim 8, wherein an overall length of said screed roller may be varied by removing at least one of said screed roller sections, by adding at least one additional screed roller section, or both.

10. The cement screeding system of claim 1, wherein said drive assembly is rotationally interconnected with said screed roller at least generally adjacent to said first end.

11. The cement screeding system of claim 1, wherein said first handle extends from said drive assembly.

12. The cement screeding system of claim 1, wherein said wet screed shoe comprises a bearing mount, and wherein said second end of said screed roller at least extends into said bearing mount.

13. The cement screeding system of claim 1, wherein said flat lower surface of said wet screed shoe has a surface area of at least about 220 in.$^2$.

14. The cement screeding system of claim 1, wherein a length dimension of said wet screed shoe is disposed orthogonally to said rotational axis of said screed roller, and wherein a length of said wet screed shoe is at least about 26 inches.

15. The cement screeding system of claim 1, wherein a width dimension of said wet screed shoe is disposed parallel with said rotational axis of said screed roller, and wherein a width of said wet screed shoe is at least about 8.5 inches.

16. The cement screeding system of claim 1, wherein said screed roller comprises a cylindrical body that engages wet concrete during screeding operations, and wherein an end portion of said cylindrical body extends over part of said wet screed shoe.

17. The cement screeding system of claim 1, wherein said screed shoe bracket extends from a rearward location of said wet screed shoe to a forward location of said wet screed shoe.

18. The cement screeding system of claim 17, wherein said screed shoe bracket extends along an arc proceeding from said rearward location of said wet screed shoe to said forward location of said wet screed shoe.

19. The cement screeding system of claim 17, wherein said screed shoe bracket extends along a semi-circular path proceeding from said rearward location of said wet screed shoe to said forward location of said wet screed shoe.

20. The cement screeding system of claim 19, wherein said rotational axis of said screed roller coincides with a center for said semi-circular path.

21. The cement screeding system of claim 1, wherein a first end of said screed shoe bracket is anchored to said wet screed shoe on one side of said rotational axis of said screed roller, and wherein a second end of said screed shoe bracket is anchored to said wet screed shoe on an opposite side of said rotational axis of said screed roller.

22. The cement screeding system of claim 21, wherein said screed shoe bracket extends along an arc proceeding between said first and second ends of said screed shoe bracket.

23. The cement screeding system of claim 1, wherein said screed roller comprises a first screed roller section that is disposed between said first and second bearing assemblies, wherein said screed roller further comprises a second screed roller section that is disposed between said first bearing assembly and where said first handle is interconnected with said screed roller.

24. The cement screeding system of claim 23, wherein there is a first spacing between said wet screed shoe and where said first handle is interconnected with said screed roller and that is measured along said rotational axis, wherein there is a second spacing between said wet screed shoe and where said second handle is interconnected with said screed roller and that is measured along said rotational axis, wherein said first spacing is larger than said second spacing.

25. The cement screeding system of claim 1, wherein said second handle comprises a gripping section, and wherein exerting a force on said gripping section exerts a force on said screed roller at spaced locations along said rotational axis that correspond with said first and second bearing assemblies.

26. The cement screeding system of claim 25, wherein an entirety of said gripping section is spaced inwardly from said second end of said screed roller.

27. The cement screeding system of claim 26, no gripping section of any handle of said cement screeding system is closer to said second end of said screed roller than said gripping section of said second handle.

28. A cement screeding system, comprising:

a screed roller comprising first and second ends;

a first handle interconnected with said screed roller;

a drive assembly rotationally interconnected with said screed roller;

a wet screed shoe interconnected with said second end of said screed roller, wherein said wet screed shoe comprises a flat lower surface;

a screed shoe bracket mounted to and maintained in a fixed position relative to said wet screed shoe;

a second handle spaced from said first handle, interconnected with said screed roller, and rigidly coupled with said screed shoe bracket, wherein said screed roller is rotatable relative to each of said wet screed shoe, said first handle, and said second handle;

a handle bracket that extends from said second handle to said screed shoe bracket, wherein said handle bracket is detachably and rigidly coupled with said screed shoe bracket, wherein said handle bracket is rotationally isolated from said screed roller at a first location, wherein said second handle is rotationally isolated from said screed roller at a second location that is spaced from said first location, and wherein said second location is between said first location and said first end of said screed roller;

a first screed shoe/handle configuration where said second handle is rigidly coupled with said screed shoe bracket at a first bracket location and that disposes and maintains said second handle in a first fixed orientation relative to said wet screed shoe; and a second screed shoe/handle configuration where said second handle is rigidly coupled with said screed shoe bracket at a second bracket location and that disposes and maintains said second handle in a second fixed orientation relative to said wet screed shoe, wherein said first and second fixed orientations are different from one another.

* * * * *